US005531531A

United States Patent [19]

Hirano

[11] Patent Number: 5,531,531

[45] Date of Patent: Jul. 2, 1996

[54] PAPER FEED DEVICE FOR A RECORDING APPARATUS

[75] Inventor: Hirofumi Hirano, Kawasaki, Japan

[73] Assignee: Canon Kabushiki Kaisha, Tokyo, Japan

[21] Appl. No.: 364,413

[22] Filed: Dec. 27, 1994

Related U.S. Application Data

[63] Continuation of Ser. No. 72,868, Jun. 4, 1993, abandoned, which is a continuation of Ser. No. 668,397, Mar. 14, 1991, abandoned, which is a continuation of Ser. No. 355,878, May 23, 1989, abandoned, which is a continuation of Ser. No. 25,812, Mar. 13, 1987, abandoned.

[30] Foreign Application Priority Data

| | | | |
|---|---|---|---|
| Mar. 18, 1986 | [JP] | Japan | 61-58085 |
| Mar. 18, 1986 | [JP] | Japan | 61-58086 |
| Mar. 28, 1986 | [JP] | Japan | 61-68814 |
| Mar. 28, 1986 | [JP] | Japan | 61-68815 |
| Apr. 15, 1986 | [JP] | Japan | 61-85040 |
| Apr. 15, 1986 | [JP] | Japan | 61-85041 |
| Apr. 15, 1986 | [JP] | Japan | 61-85042 |

[51] Int. Cl.[6] ..... B41J 11/58

[52] U.S. Cl. ..... 400/629; 271/121; 271/126; 271/170

[58] Field of Search ..... 400/624, 629; 271/114, 115, 117, 118, 119, 121, 126, 127, 167, 169, 170, 171, 124

[56] References Cited

U.S. PATENT DOCUMENTS

| | | | |
|---|---|---|---|
| 1,062,569 | 5/1913 | McLaughlin | 400/637.2 |
| 4,097,041 | 6/1978 | Fujimoto | 271/114 |
| 4,437,656 | 3/1984 | Onoda et al. | 271/119 |
| 4,438,915 | 3/1984 | Akamatso et al. | 271/9 |
| 4,494,747 | 1/1985 | Graef et al. | 271/263 |
| 4,529,189 | 7/1985 | Konishi et al. | 271/171 X |
| 4,558,858 | 12/1985 | Runzi | 271/171 X |
| 4,620,809 | 11/1986 | Runzi | 400/624 |
| 4,679,953 | 7/1987 | Sone et al. | 400/629 |
| 4,691,911 | 9/1987 | Nakagawa et al. | 271/171 X |
| 4,717,139 | 1/1988 | Sootome et al. | 271/118 |

FOREIGN PATENT DOCUMENTS

| | | | |
|---|---|---|---|
| 0157735 | 10/1985 | European Pat. Off. . | |
| 3234562 | 5/1984 | Germany . | |
| 3512068 | 10/1985 | Germany . | |
| 3608273 | 9/1987 | Germany | 271/126 |
| 140437 | 11/1980 | Japan | 271/170 |
| 183535 | 10/1983 | Japan | 271/126 |
| 183440 | 9/1985 | Japan | 271/119 |
| 258029 | 12/1985 | Japan | 271/119 |

*Primary Examiner*—David A. Wiecking

*Attorney, Agent, or Firm*—Fitzpatrick, Cella, Harper & Scinto

[57] ABSTRACT

A paper feed device for a recording apparatus includes means for containing a plurality of sheets therein, supply means for feeding the sheets from the containing means, conveyor means for feeding the sheets fed by the supply means in the paper feeding direction and in the opposite direction so as to pass through a recording station, a reversible motor for commonly driving the supply means and the conveyor means, means for driving the conveyor means in the paper feeding direction by forward rotation of the motor, driving the conveyor means in the opposite direction by reverse rotation of the motor and driving the supply means, and means for selectively inhibiting the operation of the supply means during the reverse rotation of the motor.

13 Claims, 18 Drawing Sheets

PAPER FEED DEVICE FOR A RECORDING APPARATUS

This application is a continuation of application Ser. No. 08/072,868, filed Jun. 4, 1993, now abandoned, which is a continuation of application Ser. No. 07/668,397, filed Mar. 14, 1991, now abandoned, which is a continuation of application Ser. No. 07/355,878, filed May 23, 1989, now abandoned, which was a continuation of application Ser. No. 07/025,812, filed Mar. 13, 1987, now abandoned.

BACKGROUND OF THE INVENTION

1. Field of the Invention

This invention relates to a paper feed device used in a recording apparatus, and in particular to a paper feed device for automatically feeding cut sheets.

2. Related Background Art

Generally, a recording apparatus effects recording on sheets by a recording head, and a separate cut sheet feeder is used to feed the sheets continuously and automatically. However, this cut sheet feeder is provided discretely as an option and therefore, it leads to an increased cost when the apparatus is viewed totally. Thus, it is required to reduce the cost.

The sheets are not always fed in forward direction, but in some cases, they need to be fed in reverse direction. When the sheets are so fed in reverse direction, there arises a problem to be solved between the platen of the recording apparatus and the paper feed roller of the cut sheet feeder.

Also, the sheets need be reliably held during recording, and need to be positively discharged during the discharge thereof.

FIGS. 1A–1C of the accompanying drawings show an example of the feed device according to the prior art. In these figures, reference numeral 101 designates a paper holding pressure plate supported for pivotal movement about a pivot shaft 102 and keeping accumulated sheets of printing paper 103 biased toward a paper feed roller 104. The accumulated sheets of printing paper 103 have their leading ends kept drawable in the paper feeding direction of the arrow by a separating pawl 105, and clockwise rotation of the paper feed roller 104 can feed the uppermost one of the sheets of printing paper 103.

In such a feed device, the relative position of the pivot shaft 102 and the paper feed roller 104 is set so that the paper feeding direction is kept substantially horizontal when the thickness of the held sheets of printing paper 103 has become about one half of the maximum loadage as shown in FIG. 1B, and therefore, immediately after the sheets of printing paper 103 have been placed up to the maximum loadage as shown in FIG. 1A, the point F1 at which the sheets of printing paper 103 are pressed by the paper feed roller 104, as compared with the pressing point F2 in FIG. 1B, becomes rearward on the pressing surface 104A of the paper feed roller 104, and in the state of FIG. 1C in which the number of the remaining sheets of printing paper 103 has become small, the fore end of the pressure plate 101 becomes upwardly inclined and therefore, the pressing point F3, as compared with the aforementioned pressing point F2, becomes forward on the pressing surface 104*a*.

Moreover, the feeding direction of the printing paper 103 changes and therefore, the feeding state of the printing paper 103 immediately after being separated from the separating pawl 105 becomes unstable. Also, unless the pivot shaft 102 of the pressure plate is as much spaced apart as possible relative to the axis of the paper feed roller 104, the above-described tendency becomes remarkable, and the attempt to keep the distance therebetween great has led to a large shape of the pressure plate, which in turn has led to the disadvantage that the entire printer becomes bulky.

Also, from the viewpoint of space, the spacing between the feed roller and the paper feed roller cannot be made great, and this leads to a small degree of freedom of recording sheets and to a limited amount of reverse feed of the sheets.

So, use has been made of a feed device in which the feed roller is partly cut away in the circumferential direction thereof so that a large-diametered peripheral surface and a small-diametered peripheral surface are formed and paper feeding is effected by the large-diametered peripheral surface and as far as possible the sheet is not held long by the feed roller.

FIG. 2 of the accompanying drawings shows an example of such a feed roller. In this figure, reference numeral 200 designates a feed roller, and reference characters 200A and 200B denote the small-diametered portion and the large-diametered portion, respectively, of the feed roller 200. In this case, the feed roller 200 is rotated in the direction of arrow A, whereby sheets of printing paper 201 held on a base plate, not shown, are fed in the direction of arrow F2.

However, in the paper feeding operation by such a prior-art feed roller 200, the position at which the end edge of the large-diametered portion 200B of the feed roller 200 contacts the printing paper 201 deviates rearwardly relative to the axis 200C of the feed roller 200 and therefore, the operating direction F1 of the feed roller 200 for the printing paper 201 does not coincide with the feeding direction F2 and moreover, such a contact position P is displaced back and forth by the accumulated state of the sheets of printing paper 201, and this has led to a problem that the behavior of the printing paper 201 being fed becomes unstable.

SUMMARY OF THE INVENTION

It is an object of the present invention to provide a paper feed device for a recording apparatus which realizes automatic feeding of sheets by a simplified construction.

It is another object of the present invention to enable reverse feeding of sheets to be accomplished.

It is still another object of the present invention to enable sheets to be reliably held during recording and to enable the sheets to be positively discharged during the discharge thereof.

It is yet still another object of the present invention to ensure sheets to be fed from a sheet supply source.

Other objects of the present invention will become apparent from the following detailed description thereby taken in conjunction with the accompanying drawings.

BRIEF DESCRIPTION OF THE DRAWINGS

FIG. 17 being a flow chart, FIGS. 18A–18C illustrating the operation of the device, and FIGS. 19, 20A and 20B illustrating the relation between a flange portion 21B and a separating pawl member 45.

DESCRIPTION OF THE PREFERRED EMBODIMENTS

Some embodiments of the present invention will hereinafter be described in detail and specifically with reference to the drawings. FIGS. 3 to 11 show basically a first embodiment of the present invention.

Figure 1A:
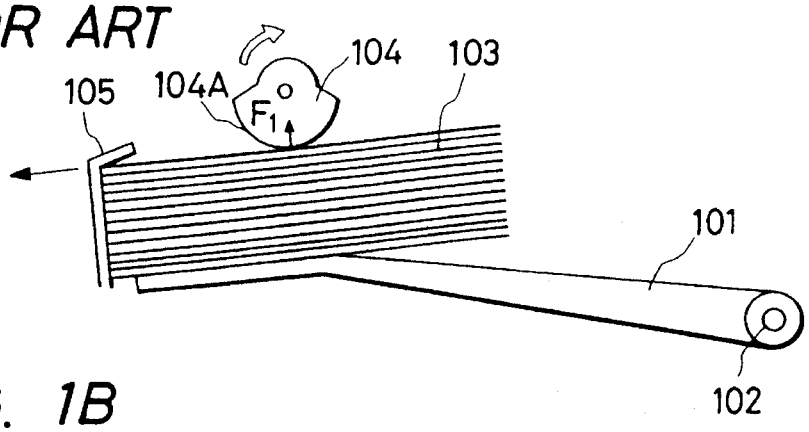
FIG. 1A PRIOR ART
FIGS. 1A–1C illustrate an example of the prior art.
Figure 1B:
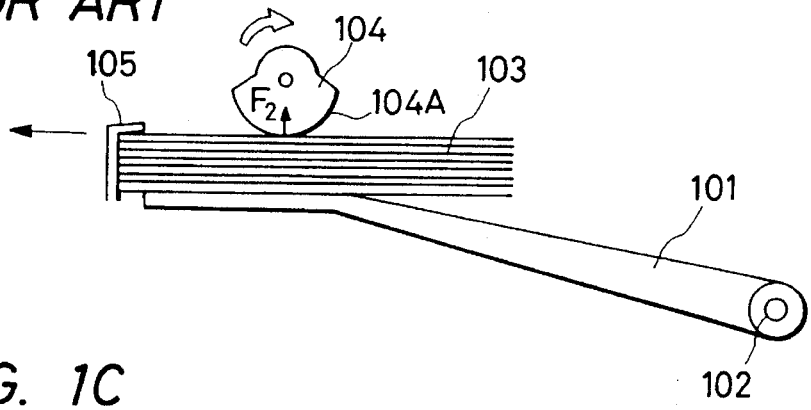
FIG. 1B PRIOR ART
Figure 1C:
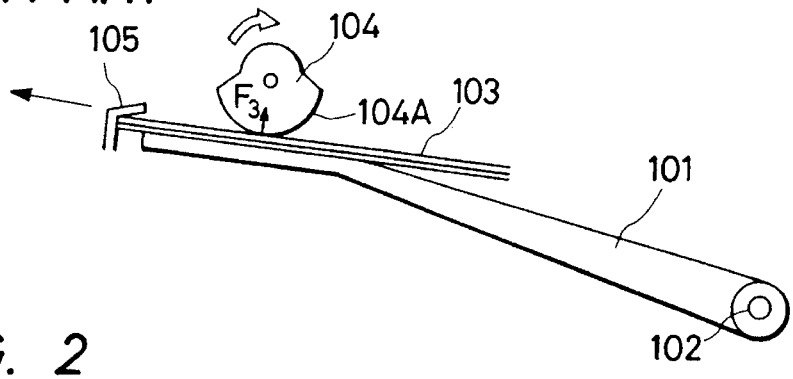
FIG. 1C PRIOR ART
Figure 2:
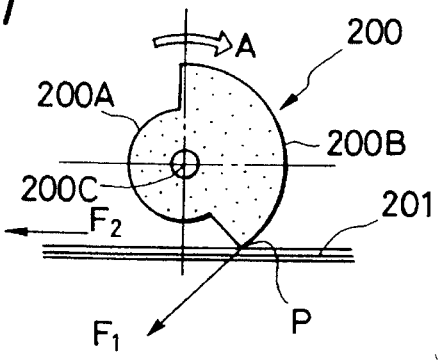
FIG. 2 PRIOR ART
FIG. 2 illustrates another example of the prior art.
Figure 3:
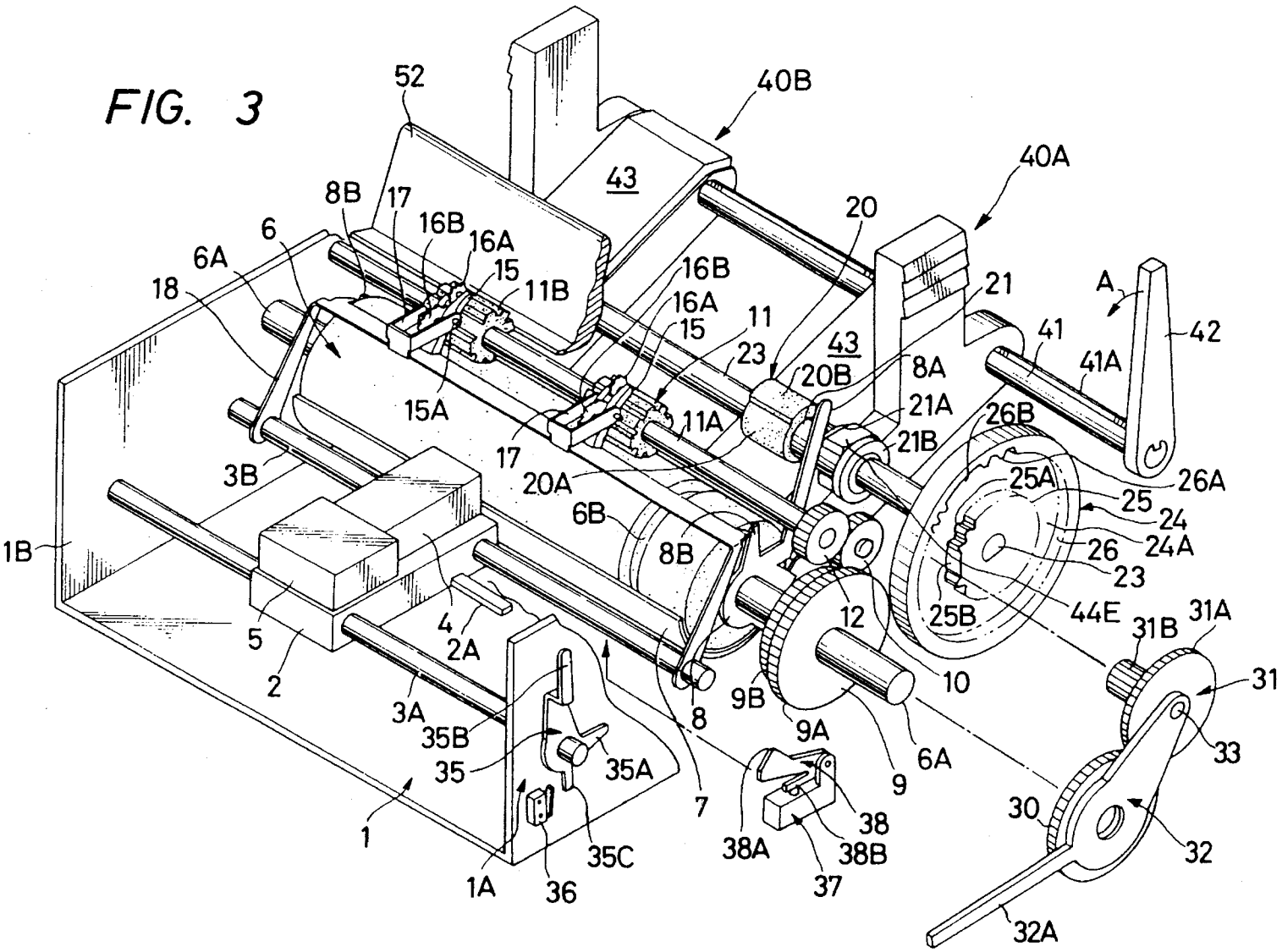
FIGS. 3 to 11 show a first embodiment of the present invention, FIG. 3 being a partly exploded perspective view showing an example of the construction of a printer according to the present invention, FIG. 4 being an exploded perspective view showing a slider which is the paper feed mechanism thereof, FIGS. 5A and 5B being cross-sectional views showing the form of the operation of the slider when it sets sheets, FIGS. 6A, 6B and 6C illustrating the states in which the operative state and paper feeding operation of a timing gear according to the present invention are inhibited, FIGS. 7A and 7B illustrating the process of operation of a paper feed roller, FIGS. 8A and 8B illustrating the process of operation when a sheet is discharged by paper discharge rollers, FIG. 9 being a block diagram, FIG. 10 being a flow chart, and FIG. 11 illustrating a case where the paper feeding operation is inhibited by a change-over lever.

In FIG. 3, reference numeral 1 designates a base plate. Guide shafts 3A and 3B, slidably supporting a carrier 2, are supported by a left side plate 1A and a right side plate 1B which are bent from the base plate 1 on the opposite sides thereof.

The carrier 2 is driven along the guide shafts 3A and 3B by a carrier motor 75 (FIG. 9) and drive means. A printing head, for example, an ink jet head 4 is mounted on the carrier 2, and a recording signal is supplied to individual nozzles provided in the printing head 4, whereby ink can be discharged from the nozzles to accomplish recording. Reference numeral 5 denotes an ink tank.

Reference numeral 6 designates a sheet feed roller formed of a material of high coefficient of friction such as rubber. The sheet feed roller 6 serves also as a platen. Reference character 6A denotes the roller shaft of the sheet feed roller 6. A trough-like paper pan 7 is held on the roller shaft 6A, and an operating member 8 provided with an operating lever 8A for disengaging a pinch roller, not shown, from the roller 6 and a restraining projection 8B is rotatably fitted on the roller shaft 6A. Reference numeral 9 designates a gear for driving the sheet feed roller 6. The gear 9 comprises a large gear 9A and a pinion 9B, of which the pinion 9B meshes with an idle gear 10 which in turn is in meshing engagement with a drive gear 12 provided on a paper discharge roller shaft 11A. When the sheet feed roller 6 is driven by a sheet feed motor 76 (FIG. 9), the paper discharge roller shaft 11A can be rotated through the intermediary of the gear 9.

Reference numeral 11 designates paper discharge rollers mounted at predetermined locations on the paper discharge roller shaft 11A. The paper discharge rollers 11 are formed of a material of high coefficient of friction such as rubber, and engaging grooves 11B for holding the trailing end edge of a sheet during paper discharge are provided in the outer peripheral portion of the paper discharge rollers. Reference numeral 15 denotes spur holders for holding gear type paper discharge spurs 16A and sheet keeping spurs 16B for contact with the paper discharge rollers 11, and reference numeral 17 designates support members for supporting the spur holders 15 by support shafts 15A. The support members 17 are mounted on a frame type spur bias lever 18, and by the spur bias lever 18 being biased toward the restraining projection 8B of the operating member 8 by a spring, not shown, the paper discharge spurs 16A and sheet keeping spurs 16B provided on the spur holders 15 can be kept in contact with the paper discharge rollers 11.

Reference numeral 20 denotes a paper feed roller having a small-diametered peripheral surface portion 20A and a large-diametered peripheral surface portion 20B and formed of rubber or the like. The paper feed roller 20 is fixed to a shaft-like paper feed roller base member 21 which is formed with flange portions 21A and 21B. Such paper feed roller 20 and the base member 21 thereof have their opposite ends slidably fitted to a paper feed roller shaft 23, which is D-shaped in cross-section so that the paper feed roller 20 and base member 21 can be rotated with the roller shaft 23.

The paper feed roller shaft 23 is supported by the side plates 1A and 1B, and has a timing gear 24 mounted on one end portion thereof. This timing gear 24 is comprised of a circumscribing gear portion 25 having an outer toothed portion 25A and an untoothed portion 25B, and an inscribing gear portion 26 provided along the outer peripheral portion thereof and having an inner toothed portion 26A and an untoothed portion 26B, and a space 24A intervenes between the circumscribing gear portion 25 and the inscribing gear portion 26.

Description will now be made of change-over means for changing over the paper feed roller 20 to the paper feed roller shaft 23 and to the roller shaft 6A through the timing gear 24 and driving the same.

Reference numeral 30 designates a paper feed roller driving gear fixed to the sheet feed roller shaft 6A and meshing with the large gear 31A of a pendulum gear 31, and reference numeral 32 denotes a swing lever pivotally supported on the sheet feed roller shaft 6A. The pendulum gear 31 has its large gear 31A and pinion 31B both supported on a pendulum gear shaft 33, and although not shown, a spring and felt are interposed between the gear shaft 33 and the pendulum gear 31 so that a predetermined friction force may act.

That is, by such friction force,,the swing lever 32 can be pivoted in the same direction with rotation of the pendulum gear 31, and the pinion 31B thereof can be biased toward the circumscribing gear portion 25 or the inscribing gear portion 26 of the timing gear 24. The swing lever 32 has a control arm 32A extending therefrom, and by this control arm 32A being engaged with the stopper portion 35A of a paper feed change-over lever 35 provided on the end portion of the carrier guide shaft 3A, pivotal movement of the swing lever 32 can be inhibited, whereby rotation of the paper feed roller 20 can be stopped as will later be described.

The paper feed change-over lever 35 is formed with a manually operated knob 35B and a switch actuating piece 35C in addition to the stopper portion 35A, and by rotating the knob 35B in a clockwise direction indicated by the arrow A, the switch actuating piece 35C can be brought into contact with a switch 36 to thereby close the switch 36. By the switch 36 being closed, the apparatus is changed over to the automatic paper feed mode, and a signal representing this fact is delivered to a central processing unit CPU, not shown. In this state, the control arm 32A of the swing lever 32 is not restrained by the stopper portion 35A.

Figure 9:
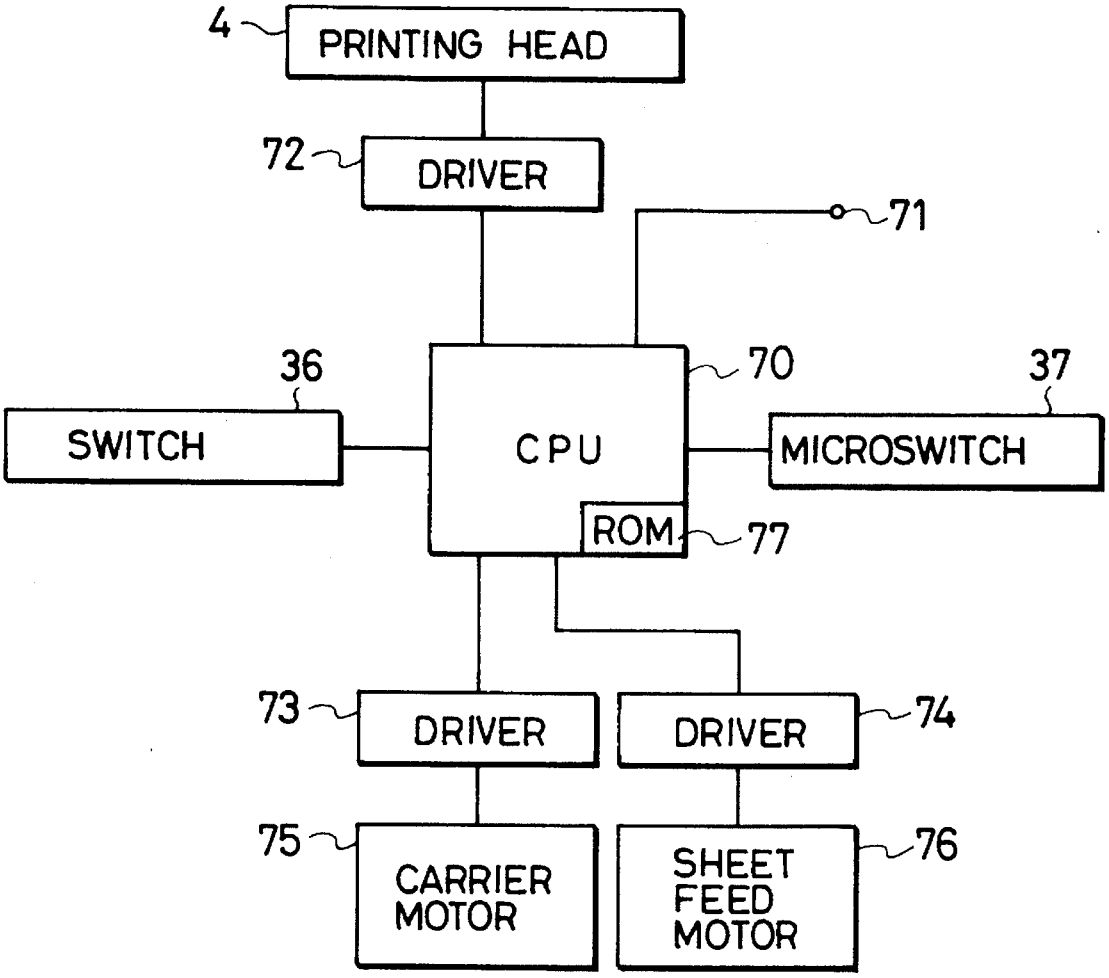

Reference numeral 37 designates a microswitch for detecting whether a sheet is wrapped around the sheet feed roller 6, reference numeral 38 denotes the detecting lever thereof, reference character 38A designates the detecting portion of the mountain-shaped lever 38, and reference character 38B denotes an actuating piece for rendering the microswitch 37 into its "ON" state by the pivotal movement of the lever 38. The microswitch 37 is fixed to the base plate 1, and the detecting portion 38A is designed to come into the groove 6B formed along the outer peripheral surface of the sheet feed roller 6, and when a sheet, not shown, is wrapped around the roller 6, the detecting portion 38A is forced out of the groove 6B by the sheet and pivots the detecting lever 38 to thereby render the microswitch 37 into its "ON" state, and supply a signal representative of "the presence of a sheet" to CPU 76 (FIG. 9).

Further, in the present embodiment, there is provided a stopper bar 2A projected from the carrier 2 in parallelism to the guide shafts 3A and 3B, and a hole, not shown, is provided in the portion of the side plate 1A which corresponds to the stopper bar 2A so that when the carrier 2 is moved to the right end, the control arm 32A of the swing lever 32 can be restrained by the stopper bar 2A.

Also, a cut-away, not shown, is formed in the portion of the paper pan 7 which corresponds to the detecting portion 38A of the microswitch 37 so that the detecting portion 38A is engageable with the groove 6B of the sheet feed roller 6.

Designated by 40A and 40B are left and right slider units slidably held on a unit guide shaft 41. The guide shaft 41 is supported by the side plates 1A and 1B and has a long groove 41A formed along the axis thereof. Reference numeral 42 denotes a paper feed lever mounted on an end of the guide shaft 41. During paper feed, the lever 42 may be tilted in the direction of arrow A to thereby accomplish the feeding of a sheet onto a pressure plate 43.

Figure 4:
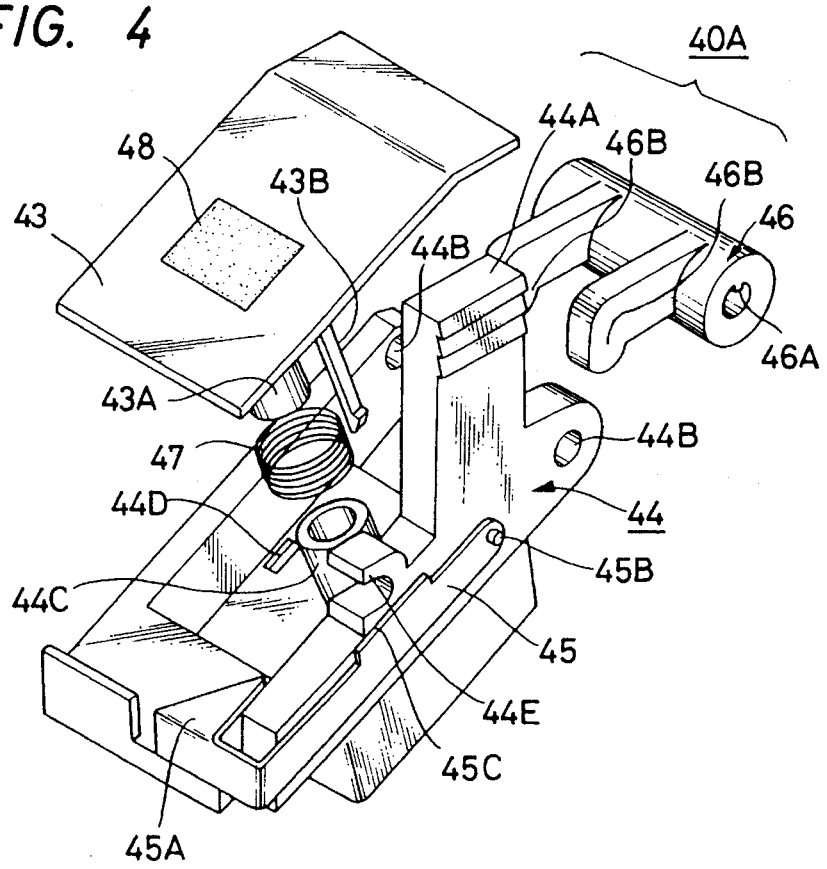

The construction of the slider units 40A and 40B will now be described in detail with reference to FIG. 4. The units 40A and 40B are constructed symmetrically with each other. In FIG. 4, reference numeral 44 designates a slider body, reference character 44A denotes the knob thereof, reference character 44B designates a guide hole for slidably supporting the body 44 on the shaft 41, reference character 44C denotes a guide cylinder provided upright from the bottom of the body 44 and slidably receiving the guide post 43A of the pressure plate 43 therein, reference character 44D designates a rectangular engaging hole for restraining the locking pawl 43B of the pressure plate 43, and reference character 44E denotes a connecting portion engaged between the flanges 21A and 21B of the paper feed roller base member 21. Reference numeral 45 designates a separating pawl holding member having a separating pawl 45A at the tip end thereof. The separating pawl holding member 45 is pivotally mounted on the slider body 44 by means of a pivot pin 45B, and the clockwise pivotal movement thereof is controlled by the stopper portion 45C at the upper end of the separating pawl holding member 45 bearing against the flange portion 21B of the paper feed roller base member 21 from therebelow.

Reference numeral 46 denotes a set arm member holding the pressure plate 43 and capable of rocking the pressure plate 43 up and down in response to the rotational movement of the guide shaft 41 caused by the paper feed lever 42. A keying protrusion 46A for engagement with the long groove 41A of the guide shaft 41 is formed in the bore of the member 46. Also, the hook-shaped arm portions 46B of the member 46 are slidably engaged with engagement holes 43C (see FIG. 5) in the back surface of the pressure plate 43 which is not shown in FIG. 4.

Further, in FIG. 4, reference numeral 47 designates a pressure plate spring for holding the pressure plate 43 in its raised position, and reference numeral 48 denotes a friction plate attached to the upper surface of the pressure plate 43. The friction plate 48 is formed of a material of relatively great coefficient of friction such as cork or felt.

FIG. 9 is a block diagram for illustrating the operation of the printer according to the present embodiment. In FIG. 9, reference numeral 70 designates a central processing circuit (hereinafter referred to as the CPU) which is the center of control. The CPU 70 drivingly controls a head 4, a carrier motor 75 and a sheet feed motor 76 through driver circuits 72–74, respectively, on the basis of data input from an input port 71. The CPU 70 includes therein a read only memory (hereinafter referred to as ROM) 77 storing therein a control procedure to be described. The CPU 70 further includes therein an RAM rewritably storing therein recording data and other data necessary for recording. The output of switch 36 is applied to the CPU 70, which can thus select the automatic paper feed mode or the manual paper feed mode. Further, the output of microswitch 37 is applied to the CPU 70, which can thus discriminate the presence or absence of a sheet and provides the result of the discrimination as a reference for the control of paper feed.

Description will now be made of the operations from the setting of sheets to the discharging of the sheets in the printer constructed as described above.

Figure 5A:
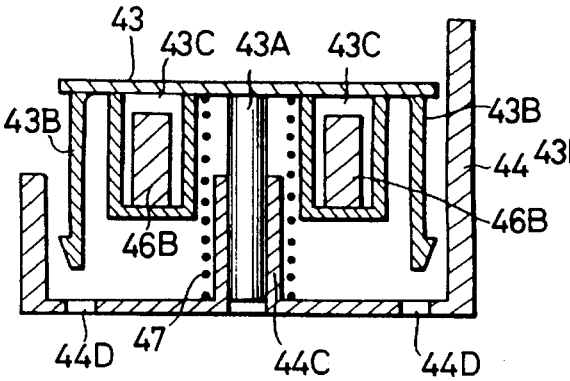
Figure 5B:
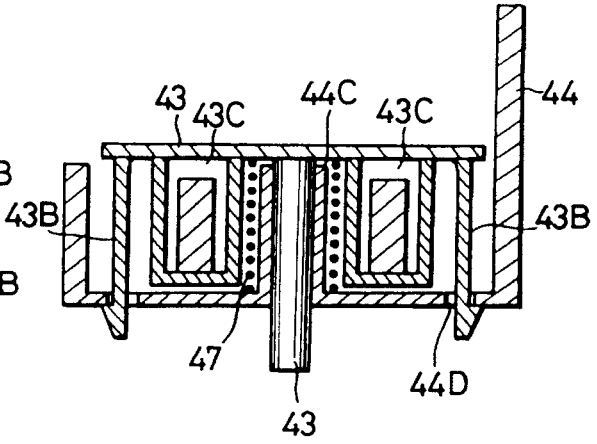

When sheets are to be set in the slider units 40A and 40B, the slider units 40A and 40B are first moved along the guide shaft 41 in conformity with the size of the sheets used and are positioned. When the paper feed lever 42 shown in FIG. 3 is then manually rotated in the direction of arrow A, the set arm member 46 shown in FIG. 4 and the pressure plate 43 engaged therewith through the engagement hole 43C, as shown in FIG. 5A, are pivotally moved against the force of the spring 47 as the guide shaft 41 is rotated, whereby the locking pawl 43B of the pressure plate 43 can be restrained in the rectangular engagement hole 44D provided in the bottom of the slider body 44 as shown in FIG. 5B.

Consequently, a required number of sheets is placed onto the pressure plate 43 and the sheets are adjusted so that the leading end edges thereof bear against the separating pawl 45A, whereafter the paper feed lever 42 is rotated in the direction opposite to the direction of arrow A to thereby release the engagement of the locking pawl 43B, and the pressure plate 43 is biased upwardly by the spring force of the spring 47, whereupon the stopper portion 45C of the separating pawl holding member 45 bears against the flange portion 21B of the paper feed roller base member 21, whereby the sheets can be set in the slider units with a predetermined gap kept between the upper surface of the sheets and the paper feed roller 20.

Figure 10:
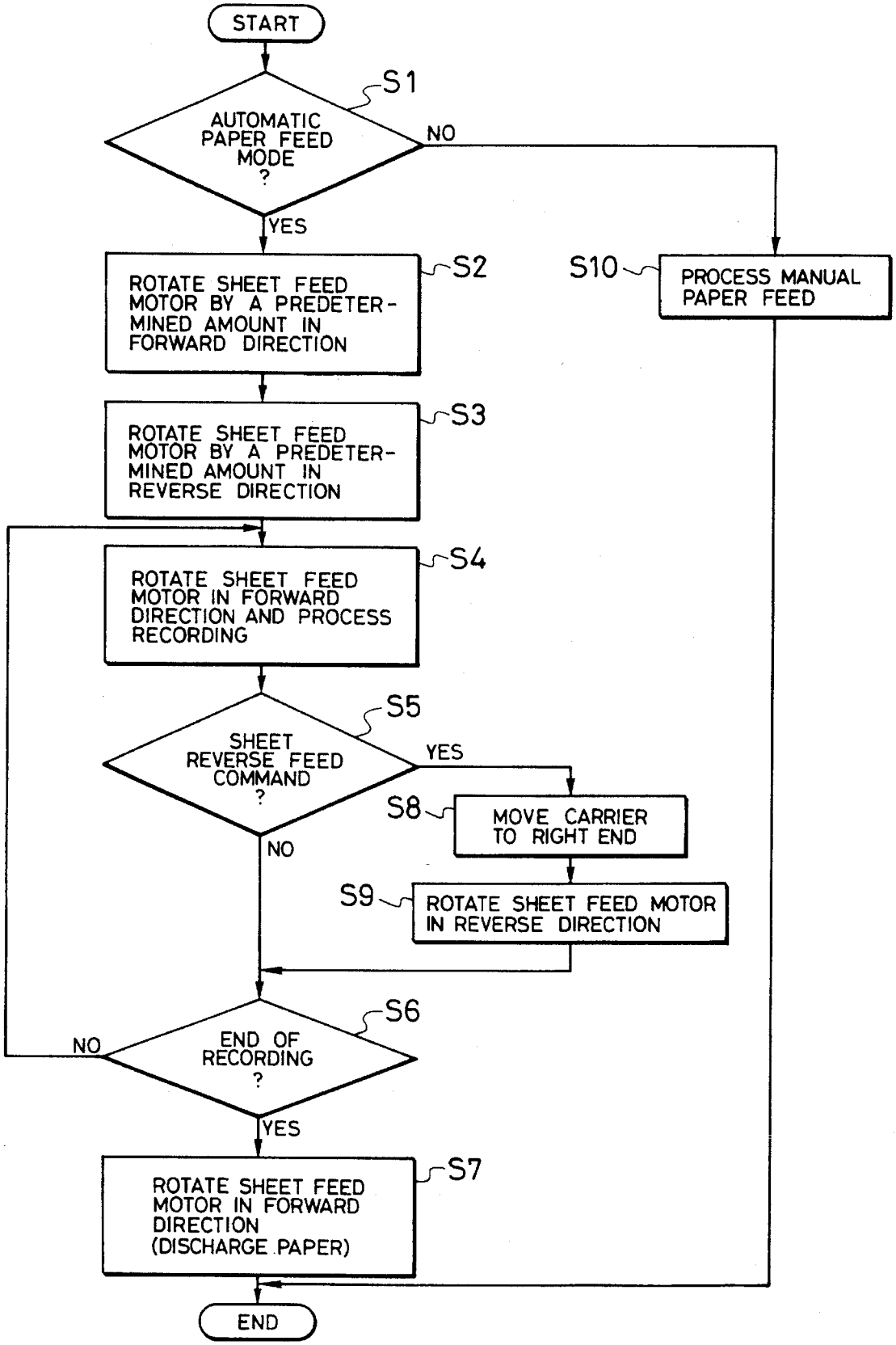
Figure 11:
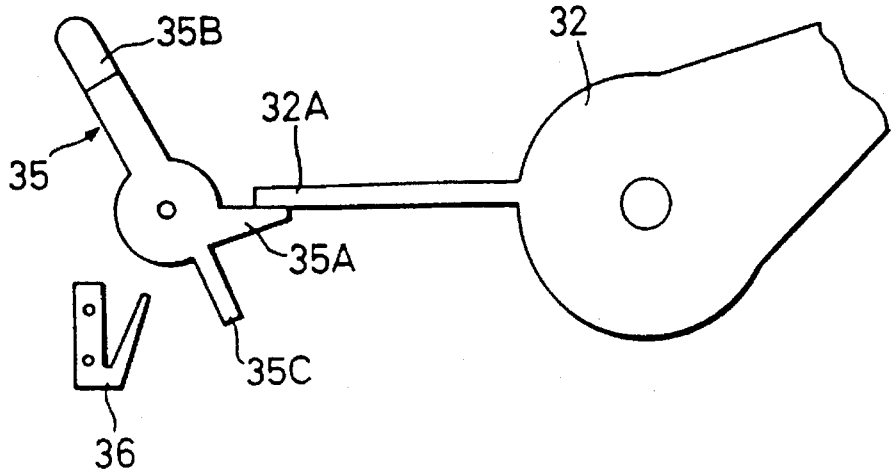

After the sheets have been thus set in the slider units, the sheet feeding operation is entered. FIG. 10 is a flow chart showing the manner of the sheet feeding operation. This operating procedure is stored in the ROM 77, as previously mentioned, and the CPU 70 carries out the following control by reference to the operating procedure.

First, at step S1, the state of the switch 36 is seen to thereby discriminate whether the apparatus is in the automatic paper feed mode or the manual paper feed mode.

(Automatic Paper Feed Mode)

When the apparatus is in the automatic paper feed mode, the sheet feed motor 76 is rotated by a predetermined amount (an amount for which the timing gear 24 can be rotated by ¾ of one full rotation) in forward direction (step 2). Here, the rotated position of the paper feed change-over lever 35 is in the state shown in FIG. 6A, and accordingly, the control arm 32A of the swing lever 32 is not engaged by the change-over lever 35 and thus, as the sheet feed roller 6 is rotated in the direction of arrow B, the swing lever 32 pivots clockwise as viewed in FIG. 3. When the swing lever 32 pivots clockwise, the swing gear pinion 31B fits the untoothed portion 25B of the circumscribing gear portion 25 of the timing gear 24 due to the previous sheet feeding operation and therefore, the paper feed roller 20 is not rotated. On the other hand, the sheet feed roller 6 is rotated in the direction of arrow B and therefore, the previous sheet nipped by and between the paper discharge roller 11 and the paper discharge spur 16A is completely discharged onto a stacker 52.

Figure 6A:
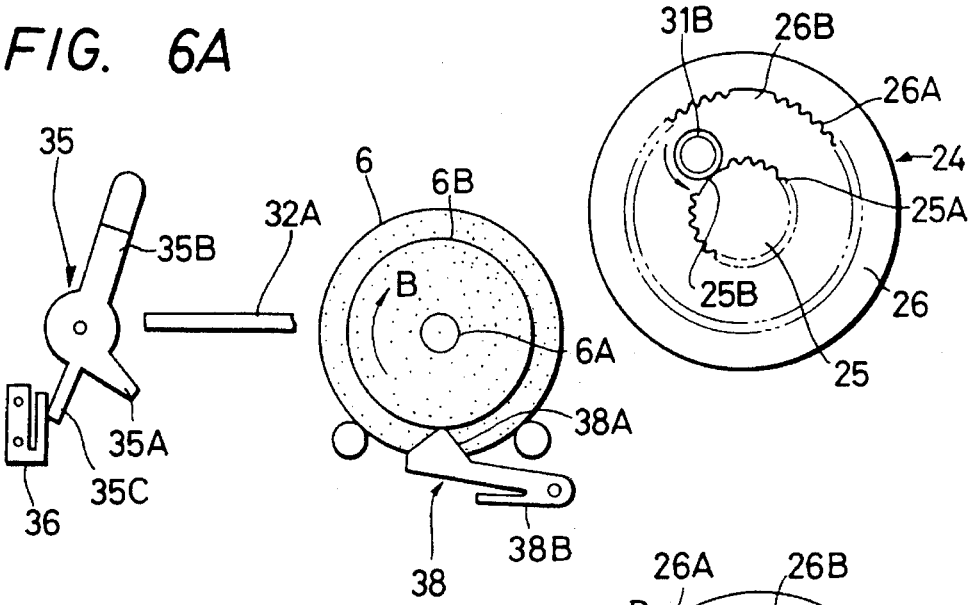
Figure 6B:
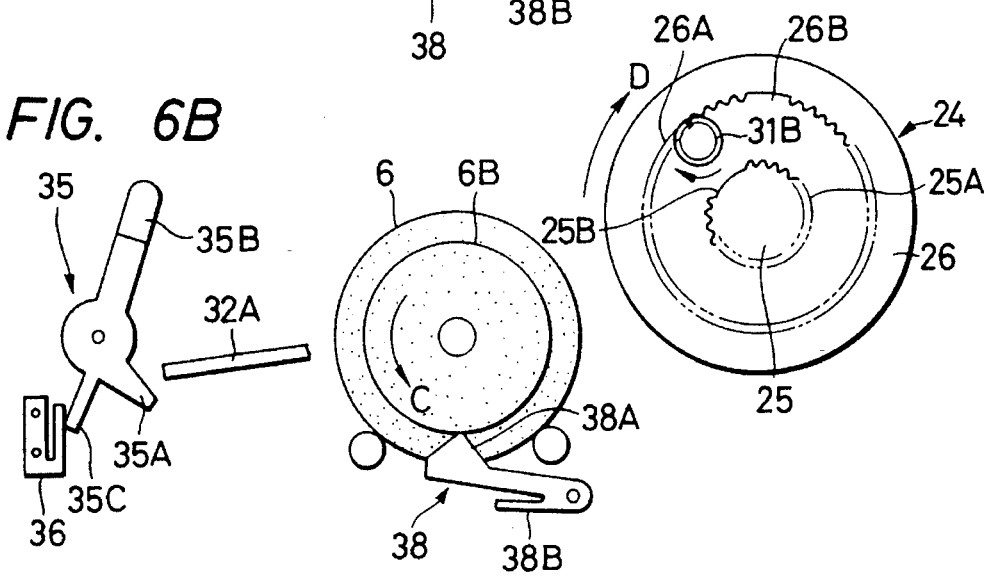

Subsequently, at step S3, the sheet feed motor 76 is rotated by a predetermined amount (an amount corresponding to ¾ of one full rotation of the timing gear) in the reverse direction. Thereby the roller 6 is rotated in the opposite direction of arrow C as shown in FIG. 6B. Thereby the swing lever 32 is also pivoted counter-clockwise and the timing gear 24 can be rotated in the clockwise direction of arrow D.

Figure 7A:
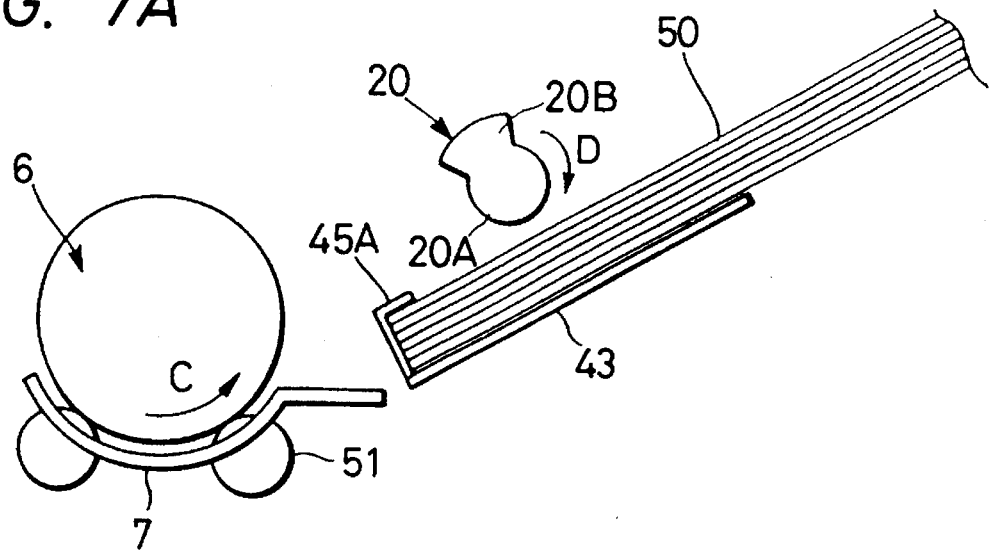
Figure 7B:
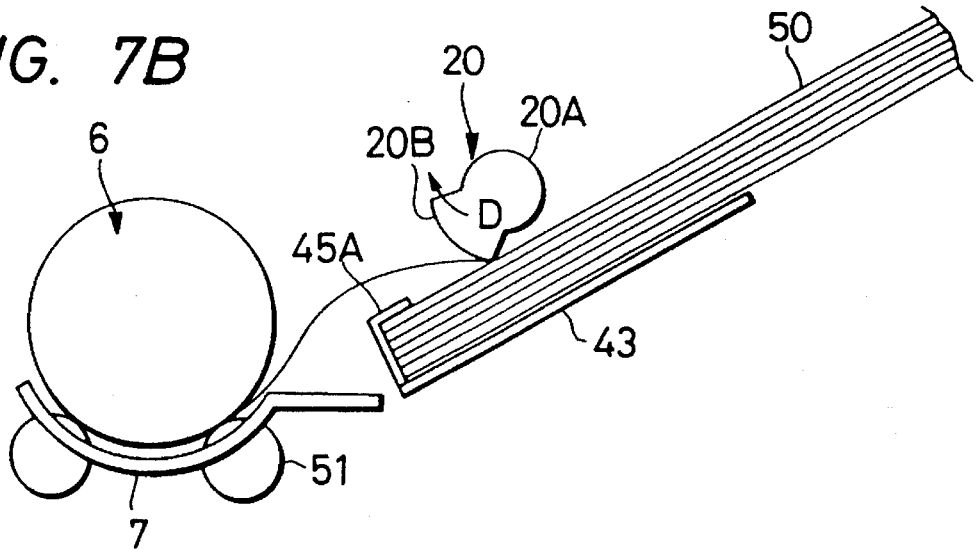

Thus, by the rotation of the timing gear 24, the paper feed roller 20 is rotated in the same direction, as shown in FIG. 7A, whereby the large-diametered peripheral surface portion 20B thereof comes into contact with the upper surface of the bundle of sheets 50 on the pressure plate 43, and the uppermost one of the sheets 50 is directed to the position at which the pinch roller 51 is in contact with the sheet feed roller 6, as shown in FIG. 7B, whereby the sheet is made into the form of a loop. Thus, when such state is brought about, in the timing gear 24, the pinion 31B of the pendulum gear 31 is directed to the cut-away portion 26B of the inscribing gear portion 26, whereby the paper feed roller 20 is once stopped. In this stopped position, the large-diametered peripheral surface portion 20B of the paper feed roller 20 still keeps down the sheet and thus, there is no danger of the formed loop disappearing.

Figure 6C:
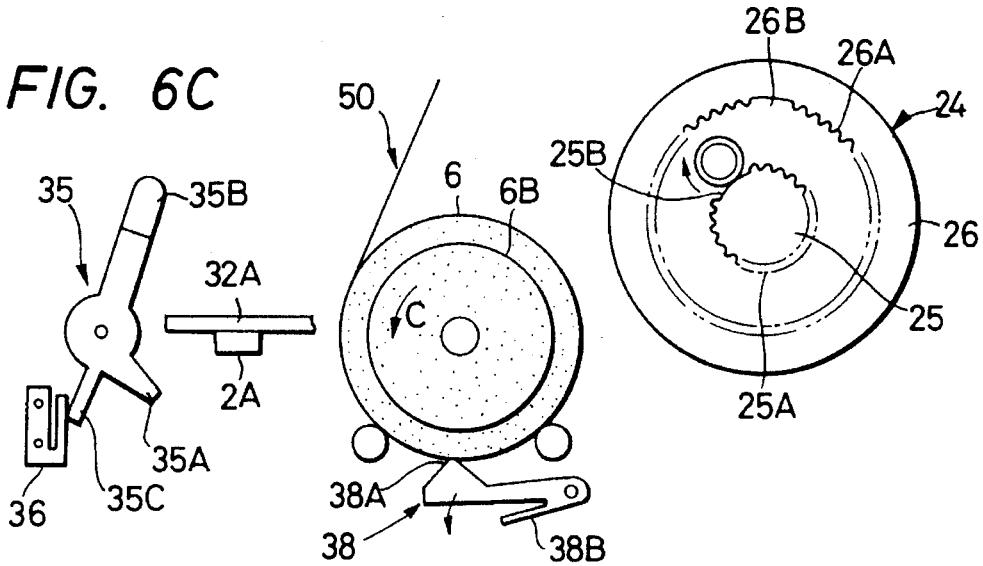
Figure 7C:
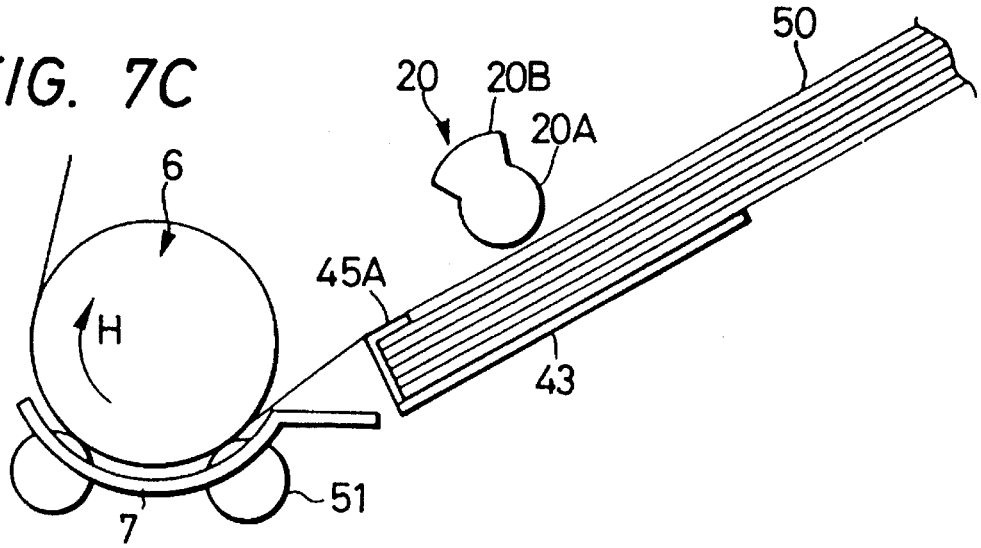

Next, at step S4, the sheet feed motor 76 is rotated in forward direction. Thereby the sheet feed roller 6 is rotated in the sheet feeding direction (the direction H) to direct the sheet 50 to between it and the pinch roller 51 and thus, the sheet can be fed upwardly from the recording station as shown in FIG. 7C. At this time, the paper feed roller 20 is rotated in the direction D as at step S3 and completely separates its large-diametered peripheral surface portion 20B from the sheet 50. However, as the paper feed roller 20 is rotated by a small amount in the direction D, the pinion 31B comes to the untoothed portion 25B of the circumscribing gear portion 25, whereupon the paper feed roller 20 is stopped. This state is shown in FIG. 6C. At this time, the paper feed roller 20 having been rotated in the direction D, but at this timing, the small-diametered peripheral surface 20A of the paper feed roller 20 is at a position opposed to the sheet 50 and accordingly, the sheet feeding by the paper feed roller 20 is not effected, but the paper feed roller 20 is stopped when the pinion 31B is rotated to the untoothed portion 25B of the circumscribing gear portion 25. Also, the detecting lever 38 of the microswitch 37 is forced out of the roller groove 6B by the sheet 50 and comes into contact with the outer surface of the sheet (see FIG. 6C), and detects the "presence of the sheet" and delivers a detection signal to the CPU.

Figure 8A:
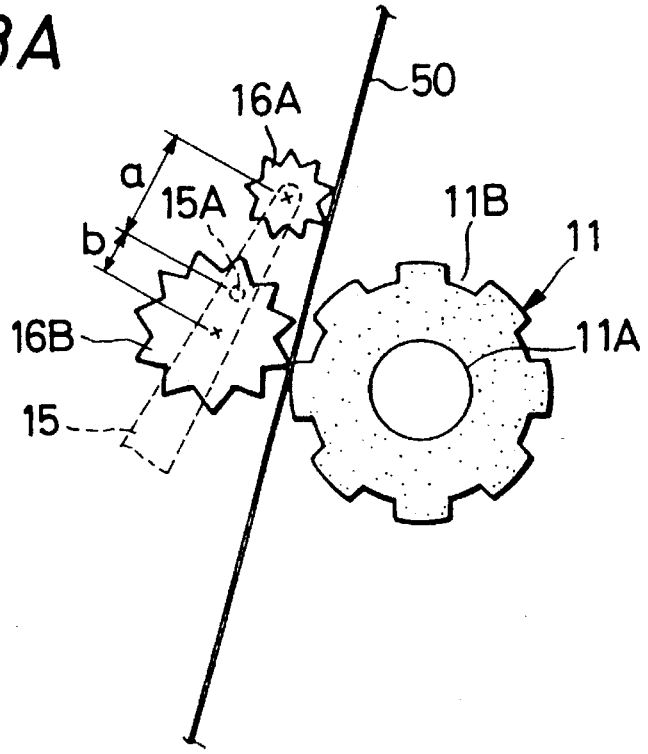

When the sheet feeding is further continued, the sheet 50 is directed to between the paper discharge roller 11 and the sheet feed spur 16B as shown in FIG. 8A, whereby the sheet 50, appropriately imparted tension by the paper discharge roller 11, is kept tensioned in front of the printing head 4. Consequently, in this state, recording is effected on the sheet 50 by the printing head 4.

When recording of a predetermined amount (an amount corresponding to one line) is effected, whether there is a sheet reverse feed command is judged at step S5. When there is not the sheet reverse feed command, whether recording has been terminated is judged at step S6. This is judged by whether the CPU 70 has discharged all the recording data. If recording is not terminated, steps S4–S6 are repeated. When recording has been terminated, the sheet feed motor 76 is rotated in forward direction at step S6 to cause the sheet to be completely discharged into the stacker 52.

In this case, the relation between the paper discharge spur 16A and the sheet spur 16B is such that because the spur holder 15 is supported at a position toward the spur 16B by the support member 17 of the spur lever 18, most of the force biasing the spurs 16A and 16B toward the paper discharge rollers 11 through the spur lever 15 is exerted on the sheet feed spur 16B. In FIG. 8A, letter a represents the distance between the support shaft 15A and the center of rotation of the paper discharge spur 16A, and letter b represents the distance between the support shaft 15A and the center of rotation of the sheet keep spur 16B, and a>b. So, in the state of FIG. 8A, the sheet 50 is nipped between the spur 16B and the paper discharge roller 11 chiefly by the spur 16B alone, and the other spur 16A has not enough force to push back the sheet 50 because of the resiliency of the sheet 50 and is merely in light contact with the sheet 50 along the tangential direction thereof.

Figure 8B:
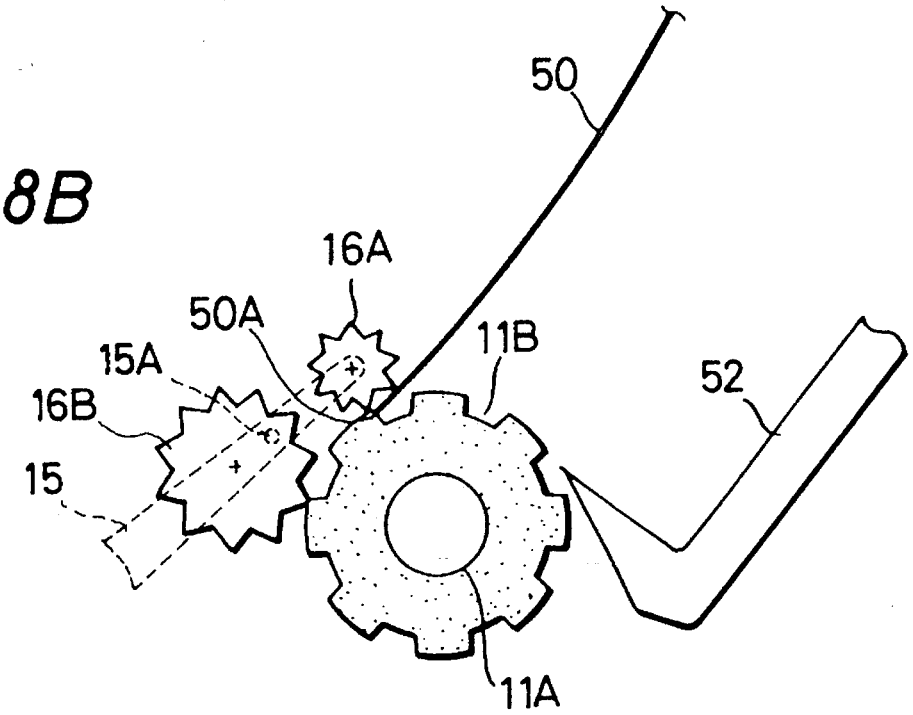

Thus, when the trailing end edge 50A of the sheet 50 is fed to a position as shown in FIG. 8B as a result of the continued sheet feeding after the termination of recording, the trailing end edge 50A is guided by the paper discharge spur 16A and falls into engagement with the engagement grooves 11B of the paper discharge rollers 11, and the sheet 50 is received into the stacker 52 with the aid of the paper discharge rollers 11.

On the other hand, when there is a sheet reverse feed command in the course of recording, the carrier motor 75 is driven at step S8 to move the carrier 2 to the vicinity of the right end as viewed in FIG. 3. When the carrier 2 is moved to the vicinity of the right side plate 1A, the stopper bar 2A is protruded outwardly of the side plate 1A to restrain the control arm 32A of the swing lever 32 as shown in FIG. 6C.

Subsequently, at step S9, the sheet feed motor 76 is rotated by a predetermined amount in reverse direction. Thus, by the reverse rotation of the motor 76, the feed roller 6 feeds the sheet in reverse direction by an amount corresponding to the amount of rotation thereof. However, when the swing lever 32 tries to pivot counter-clockwise simultaneously therewith, the swing lever 32 is prevented from pivoting by the control arm 32A thereof being restrained by the stopper bar 2A and accordingly, the pinion 31B of the pendulum gear is kept in contact with the untoothed portion 25B of the circumscribing gear portion 25, whereby the paper feed roller 20 is not rotated, and in this state, the paper feed roller 20 is out of contact with the sheet 50 as shown in FIG. 7A and thus, sheet feeding in reverse direction can be freely carried out.

(Manual Paper Feed Mode)

Description will now be made of a case where feeding of one sheet or feeding of the sheet in reverse direction is manually effected by means of a sheet feed knob, not shown. In such case, the paper feed change-over lever 35 is pivoted counter-clockwise as shown in FIG. 9 to keep the switch 36 in its "OFF" state, i.e., the manual paper feed state. This state of the switch 36 is detected at step S1, and at step S10, the sheet is fed in the recording direction or in reverse direction by means of the knob, not shown. At this time, the pivotal movement of the swing lever 32 is inhibited by the stopper portion 35 of the change-over lever 35 and the sheet can be freely moved in forward or reverse direction.

As described above, according to the first embodiment, in the automatic paper feed mode, when the sheet feed rotatable member is to be rotated in reverse direction, the drive means for the sheet feed rotatable member is checked in relation to the carrier which is in its retracted position and therefore, the feed drive of a printer can be provided which can execute reliable automatic feeding simply by changing over the rotation of a motor to forward or reverse direction at a predetermined timing without requiring any complicated mechanism and which is inexpensive.

Also, the peripheral surface of the sheet feed rotatable member is formed into circumferentially two stages, i.e., a large-diametered portion and a small-diametered portion, whereby after a sheet has been fed to the sheet feed rotatable member, reverse feeding of the sheet can be easily accomplished without the sheet feed rotatable member contacting the sheet.

(Another Embodiment)

Figure 12:
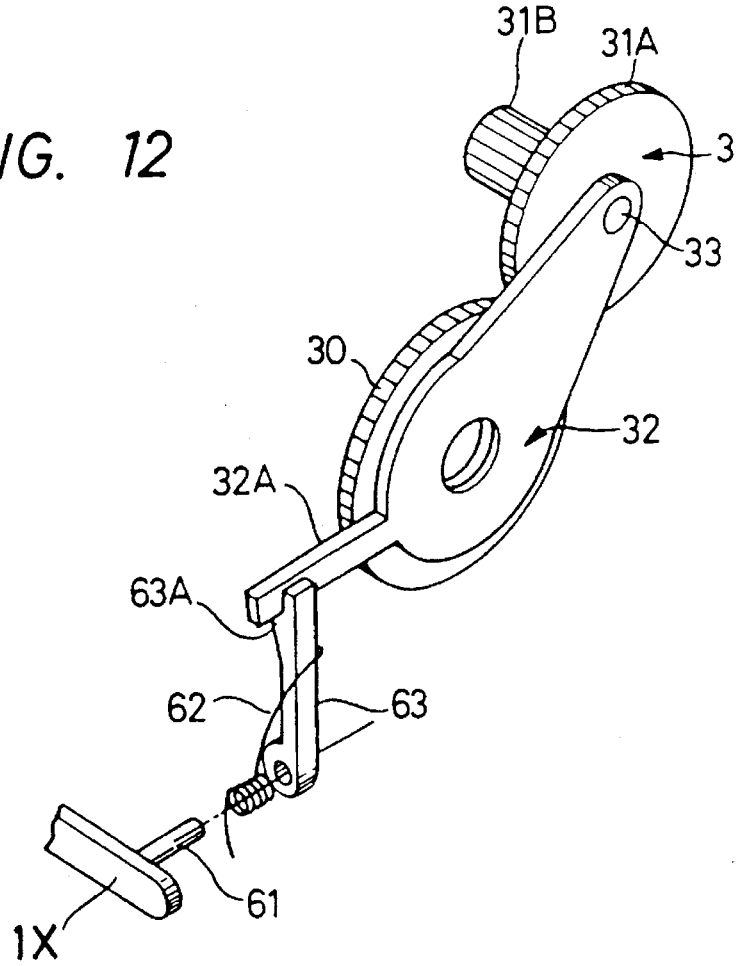
FIG. 12 is a perspective view of a second embodiment of the present invention.

FIG. 12 shows a second embodiment of the present invention. The portions not shown in FIG. 12 are identical to those of the first embodiment. In FIG. 12, reference character 1X designates a portion protruded from the vicinity of the bottom of the side plate 1A shown in FIG. 3. In the present embodiment, a shaft pin 61 is provided on the protruded portion 1C, and a coil spring 62 and a lock lever 63 are mounted on the shaft pin 61 so that the lever 63 may retain a counter-clockwise rotational force by the spring force of the spring 62. Thus, in the ordinary case where no automatic paper feeding is effected, the control arm 32A of the swing lever 32 is kept restrained by the restraining pawl 63A of the lock lever 63, so shown in FIG. 12.

That is, as far as such a state is kept, the sheet can be freely fed in forward or reverse direction by the manual operation of the knob as described above. Also, in the case of automatic paper feed, when the carrier 2 has been moved to the right side plate 1A, the stopper bar 2A thereof pressed the belly of the lock lever 63 against the spring force to release it from its restrained state. Consequently, in this state, paper feeding can be accomplished by a procedure and operation similar to those previously described. When the sheet is to be fed in reverse direction, it is necessary to restore the restrained state of the swing lever 32 as shown in FIG. 12.

(Another Embodiment)

Figure 13:
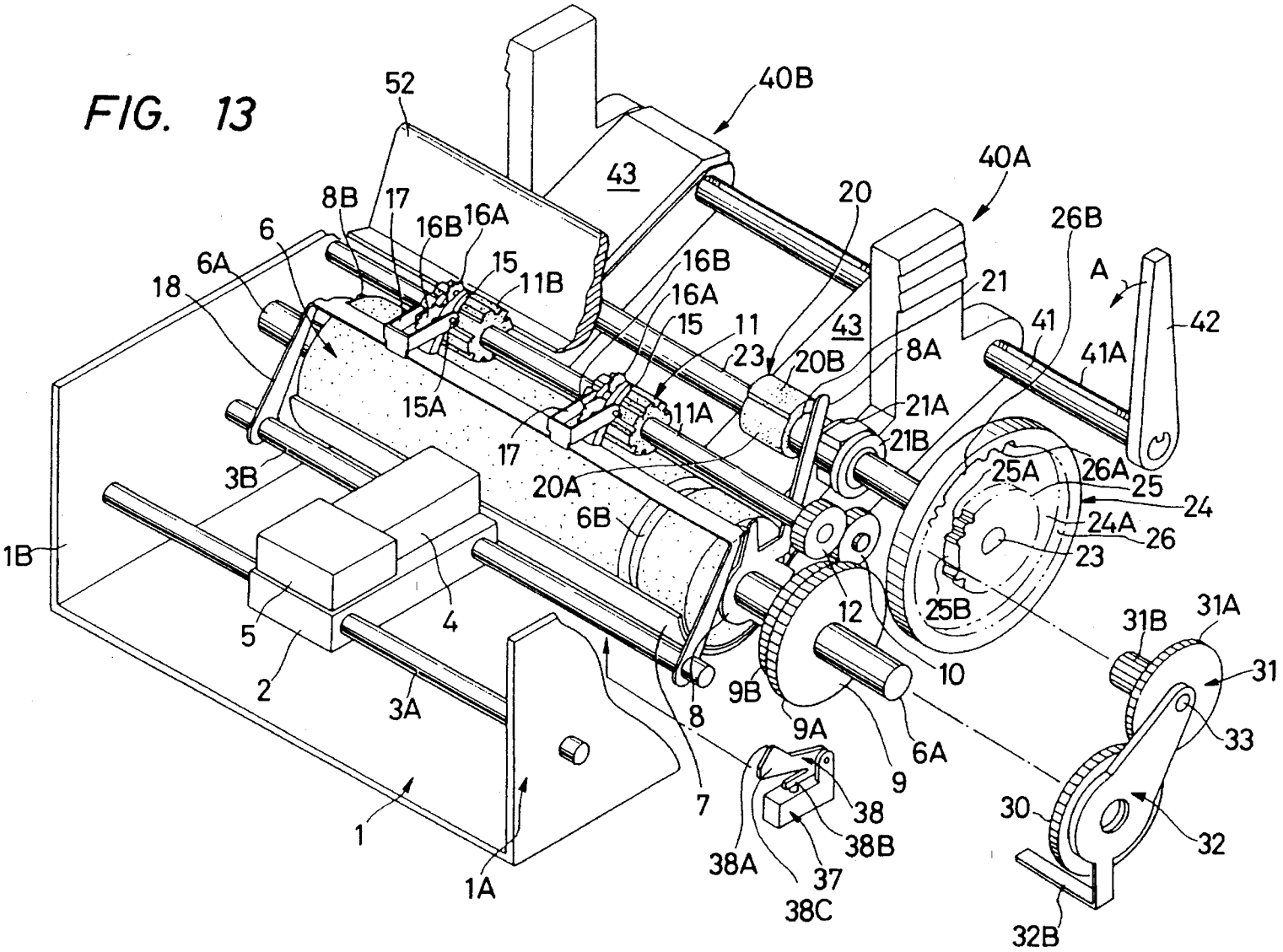
FIGS. 13 to 14A–14C show a third embodiment of the present invention, FIG. 13 being a perspective view of the entire device, and FIGS. 14A–14C illustrating its operation.

FIGS. 13 and 14 show a third embodiment of the present invention. In the first embodiment, the paper feed change-over lever 35 is provided in order that the paper feed roller may not feed the next sheet when the sheet feed roller 6 is rotated in reverse direction to feed the sheet in reverse direction. Also, during the reverse feeding of the sheet, the carrier 2 is moved to the vicinity of the right end as viewed in FIG. 3 and rotation of the swing lever 32 is controlled by the stopper bar 2A.

In the third embodiment, however, use is made of a microswitch for detecting the pressure or absence of a sheet and rotation of the paper feed roller 20 is controlled when the sheet is wrapped around the sheet feed roller 6.

The present embodiment will now be described in detail. In the present embodiment, portions similar to those in the first embodiment are given similar reference characters and need not be described.

In FIG. 13, the control arm 32B of the swing lever 32 is protruded downwardly and has its end portion bent into U-shape toward the microswitch 37.

Figure 14A:
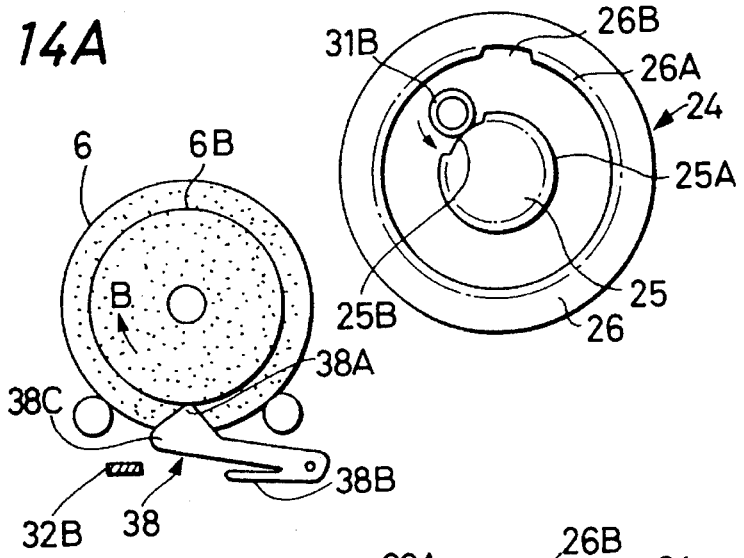

The operation of feeding a sheet held on the sheet feed roller 6 will now be described. At the initial stage of the ordinary feeding, as shown in FIG. 14A, no sheet is yet fed to the sheet feed roller 6 and accordingly it does not happen that the detecting portion 38A of the sheet detecting lever 38 is kept fitted in the roller groove 6B, whereby the control arm 32B of the swing lever 32 is restrained by the detecting arm 38C of the microswitch 37, and thus, as the sheet feed roller 6 is rotated in the direction arrow B, the lever 32 is pivoted clockwise as viewed in FIG. 13, and the pinion 31B of the swing gear becomes positioned at the untoothed portion 25B of the circumscribing gear portion 25 of the timing gear 24.

Figure 14B:
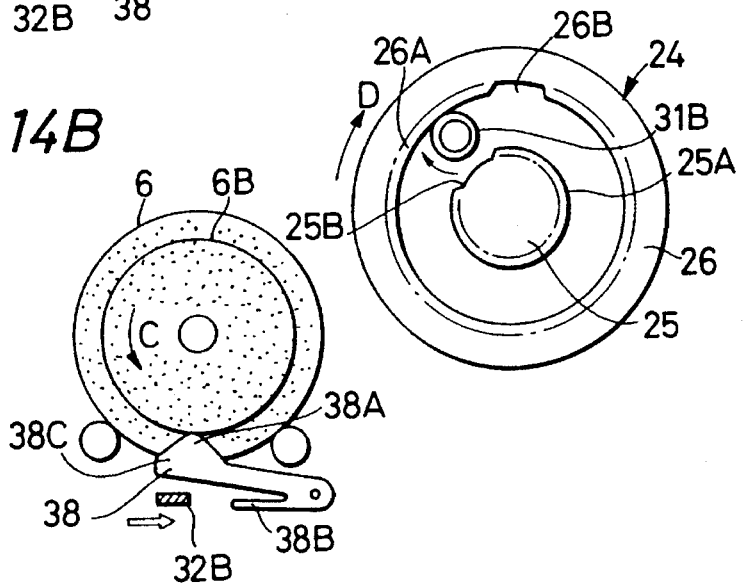

So, the roller 6 is first driven in the direction of arrow C by the motor 76 as shown in FIG. 14B, whereby the swing lever 32 and its control arm 32B can be pivoted counter-clockwise and the timing gear 24 can be rotated in a clockwise direction D. Moreover, in this state, the control arm 32B of the swing lever is rotated in the same direction without being restrained by the detecting lever 38.

Thus, by the rotation of the timing gear 24, the paper feed roller 20 is rotated in the same direction, as shown in FIG. 7A, whereby the large-diametered peripheral surface portion 20B thereof comes into contact with the upper surface of the bundle of sheets 50 on the pressure plate 43, and the uppermost one of the sheets 50 in directed to the position at which the pinch roller 51 is in contact with the sheet feed roller 6, as shown in FIG. 7B, and is made into the form of a loop. Thus, in this state, in the timing gear 24, the pinion 31B of the pendulum gear 31 is directed to the cut-away portion 26B of the inscribing gear portion 26, whereby the paper feed roller 20 is once stopped.

Figure 14C:
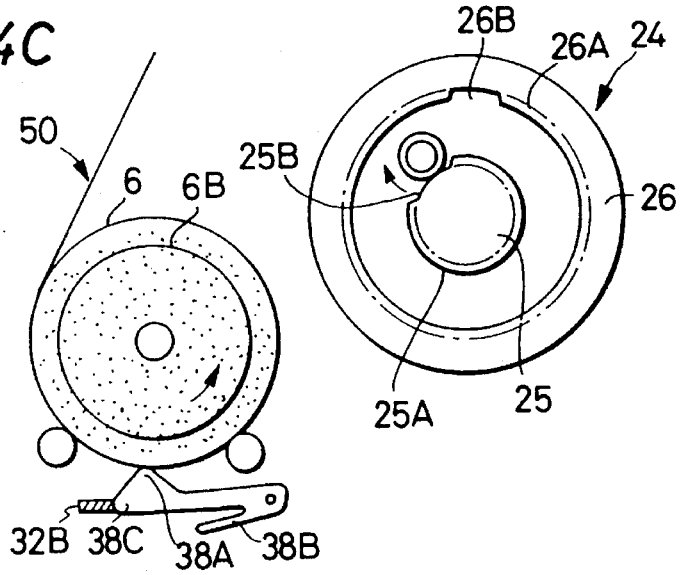

So, subsequently, the sheet feed motor 76 is rotated in the sheet feeding direction to rotate the sheet feed roller 6, whereby as shown in FIG. 7C, the sheet 50 can be interposed between the sheet feed roller and the pinch roller 51 and the leading end edge thereof can be fed upwardly from the recording station. At this time, the paper feed roller 20 is also rotated, but at this timing, the small-diametered peripheral surface portion 20A of the paper feed roller 20 is at the position opposed to the sheet 50 and accordingly, the sheet feeding by the paper feed roller 20 does not take place, and the paper feed roller 20 is stopped when the pinion 31B has been rotated to the untoothed portion 25B of the circumscribing gear portion 25. Also, in this state, the detecting lever 38 of the microswitch 37 is forced out of the roller groove 6B by the sheet 50 and is kept in contact with the surface of the sheet as shown in FIG. 14C, thereby delivering a signal representative of the "presence of a sheet" to the CPU 70.

Thus, when the detecting lever 38 is kept in the posture of outputting such a signal representative of the "presence of a sheet", the control arm 32B of the swing lever 32 bears against the detecting arm 38C of the lever 38, whereby counter-clockwise rotation of the swing lever 32 is checked through the control arm 32B.

So, as long as the sheet 50 is kept wrapped around the sheet feed roller 6, the paper feed roller 20 is not rotated through the intermediary of the timing gear 24 even if the sheet feed roller 6 is rotated in reverse direction, and the small-diametered peripheral surface portion 20A of the paper feed roller 20 is located at the position opposed to the upper surface of the bundle of sheets 50 as shown in FIG. 7C and therefore, sheet feeding is not effected by mistake.

(Another Embodiment)

FIGS. 15 to 20 show a fourth embodiment of the present invention. In this embodiment, a trigger device including a solenoid is provided to rotate not the paper feed roller 20, but only the sheet feed roller 6 in reverse direction. In the fourth embodiment, members similar to those in the first embodiment are given similar reference characters and need not be described.

Figure 15:
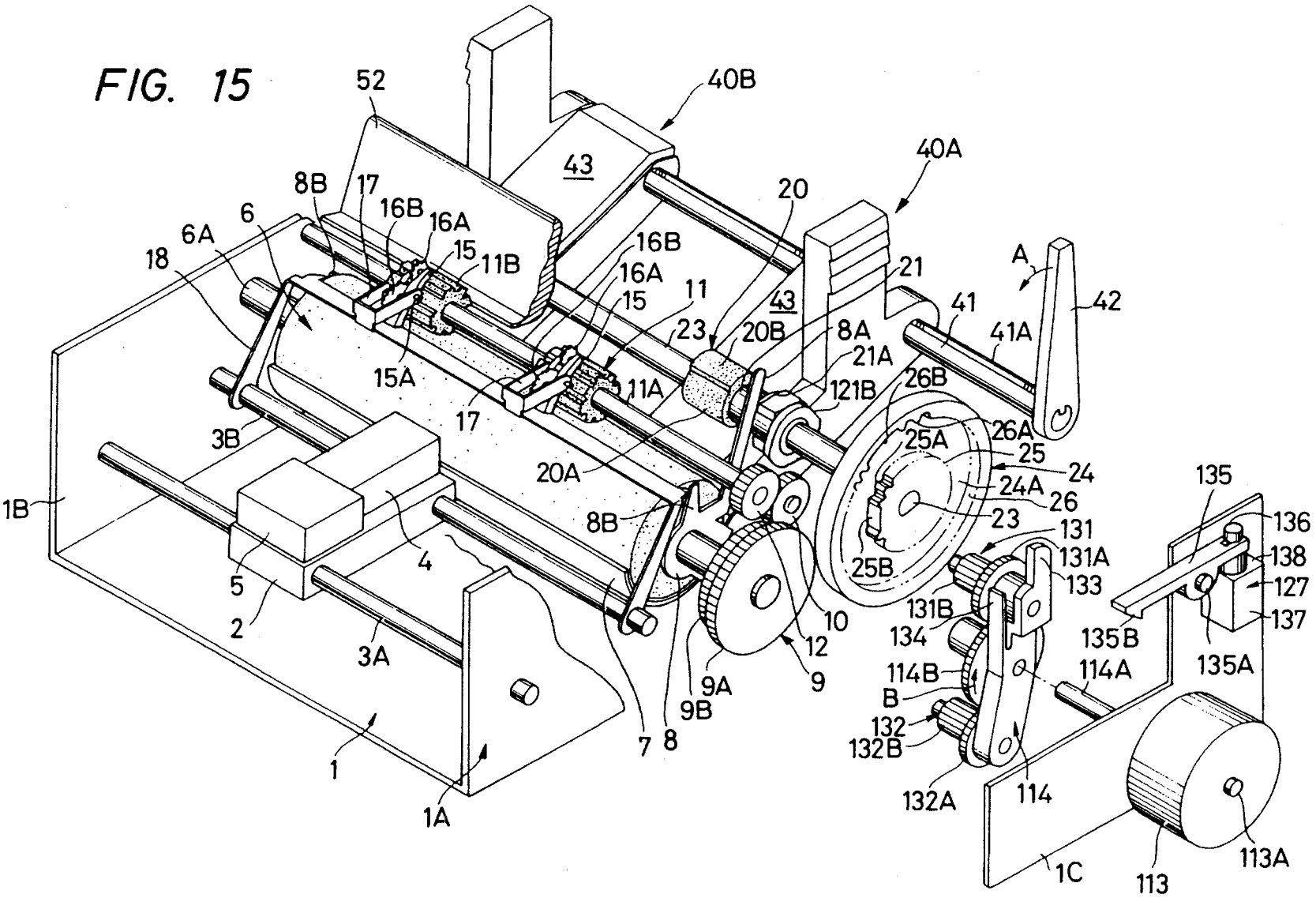
FIGS. 15 to 20 show a fourth embodiment of the present invention, FIG. 15 being a perspective view of the entire device, FIG. 16 being a block diagram.

Referring to FIG. 15, a sheet feed motor 113 is mounted on a motor base plate 1C fixed so as to keep a predetermined spacing with respect to the side plate 1A, and a trigger device 127 is further fixed to the base plate 1C. Thus, an idle gear 114B provided on a swing lever member 114 can be rotated by the motor 113 through a pinion gear, not shown, mounted on the shaft 113A of the motor 113 and a swing lever shaft 114A. The swing lever member 114 is pivotally supported on the swing lever shaft 114A.

Reference numerals 131 and 132 designate a swing gear and a sheet feed gear, respectively, supported on the upper and lower wings of the swing lever member. A large gear 131A and a pinion 131B are provided in the gear 131, and a large gear 132A and a pinion 132B are provided in the gear 132, and the respective large gears 131A and 132A are in meshing engagement with the idle gear 114B. Reference numeral 133 denotes an engaging member attached to the lever member 114, and reference numeral 134 designates a resilient friction piece.

The trigger device 127 is further comprised of a trigger lever 135 pivotally supported by a shaft 135A and having a restraining hook 135B formed at the end thereof, a plunger 136 for operating the trigger lever 135, a trigger solenoid 137, and a return spring 138.

Figure 16:
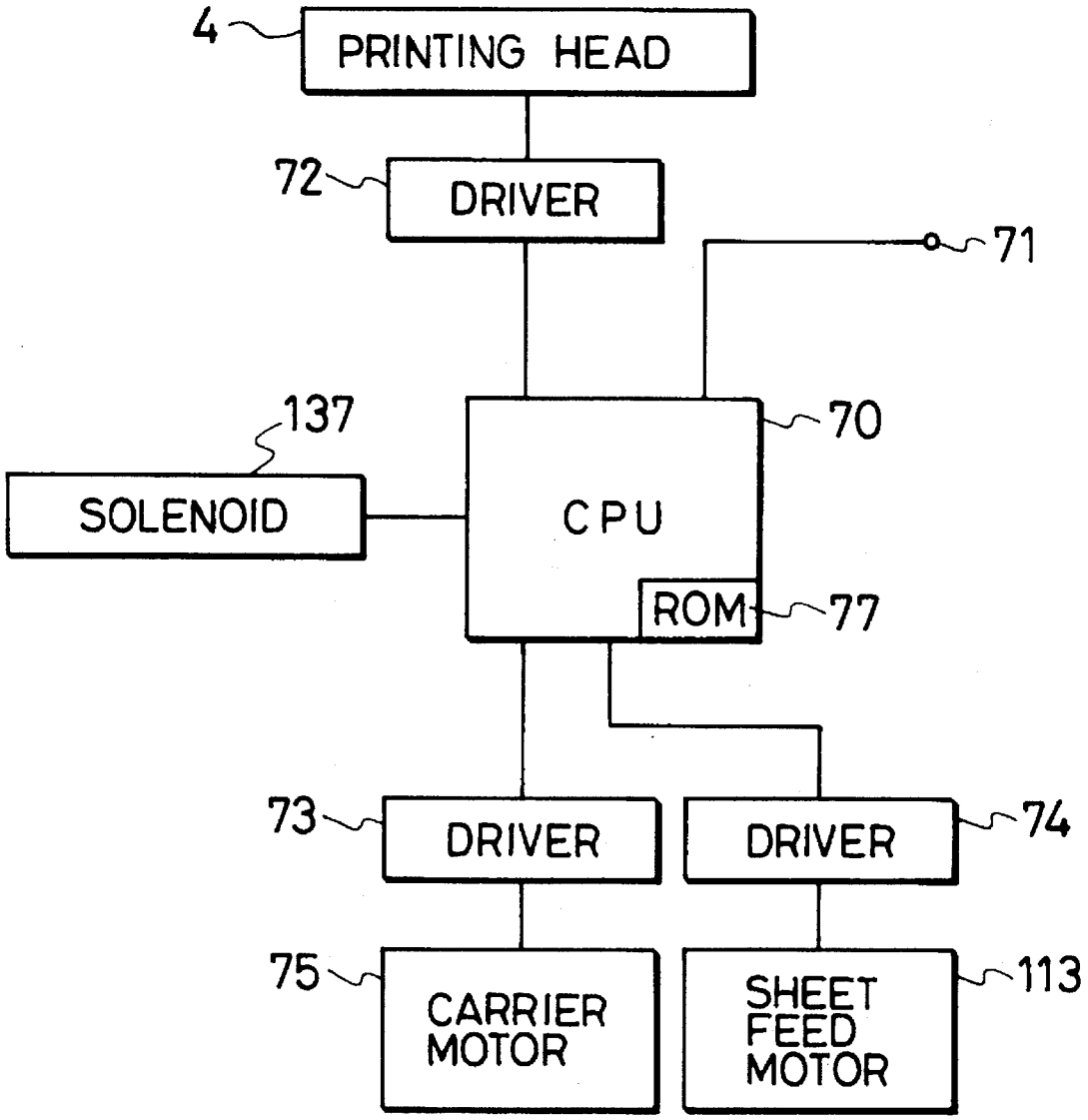

Referring to FIG. 16 which is a block diagram of the present embodiment, CPU 70 is substantially the same as that in the first embodiment with the exception that it operates the solenoid 137, whereby paper feeding is started by the sheet feed motor 113.

Figure 17:
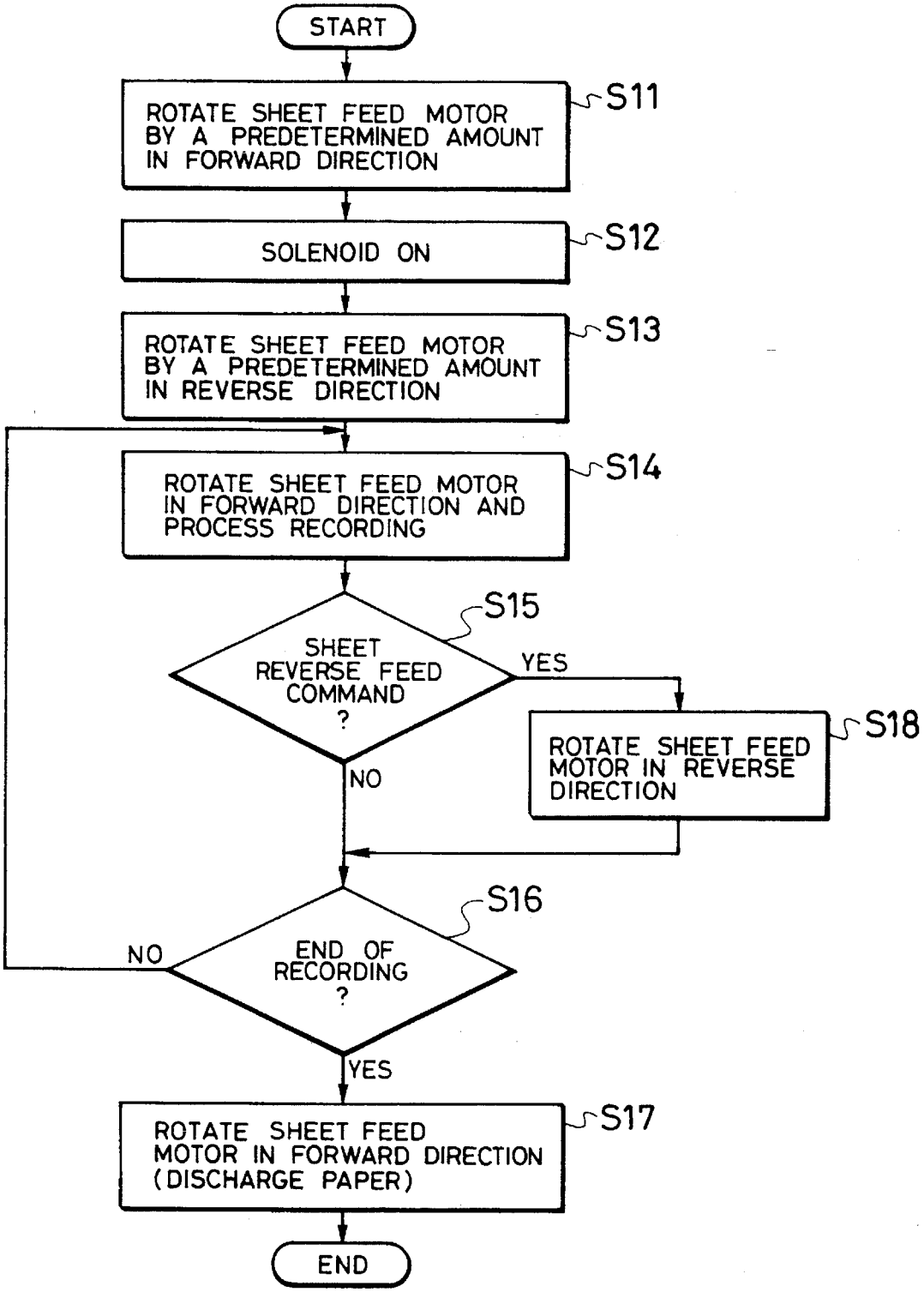
Figure 18A:
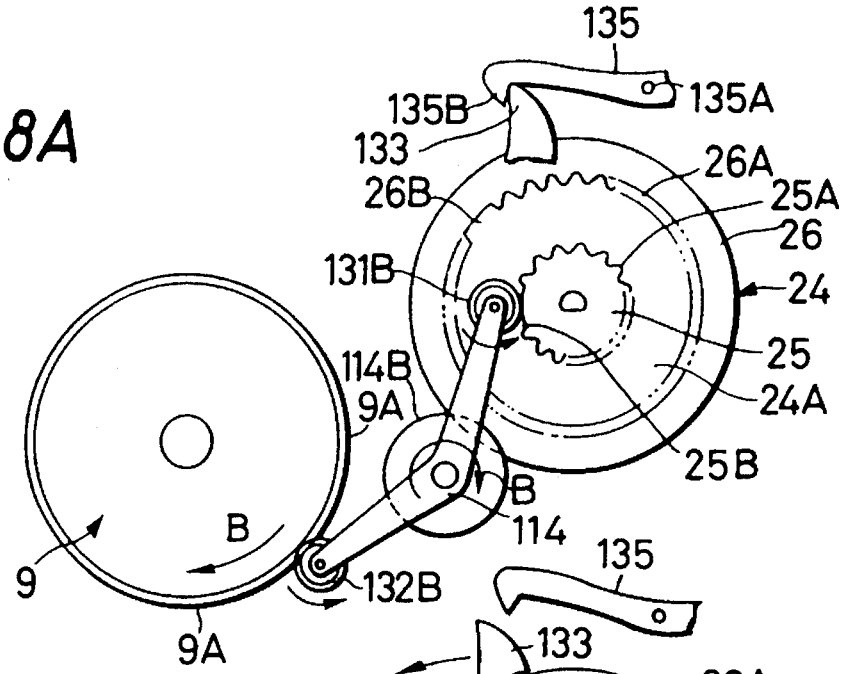

FIG. 17 shows a control procedure stored in ROM 77, and the sheet feeding operation will hereinafter be described with reference chiefly to this figure. First, at step S11, the sheet feed motor 113 is rotated by a predetermined amount in forward direction. At this time, the engaging portion 133 of the swing lever member 114 is engaged by the trigger lever 135 as shown in FIG. 18A, whereby the swing gear pinion 131B of the swing lever member 114 is positioned on the untoothed portion 25B of the circumscribing gear portion 25 of the timing gear 24. On the other hand, the pinion 132B of the sheet feed gear 132 supported on the other end portion of the swing lever member 114 is in meshing engagement with the large gear 9A on the sheet feed roller shaft 6A. Accordingly, the paper feed roller 20 is not rotated, but only the sheet feed roller 6 is rotated in a direction 6 in order to is completely discharge paper into the stacker 52.

Subsequently, at step S12, the trigger solenoid 137 is electrically energized to attract the plunger 136 and pivot the trigger lever 135 clockwise, thereby releasing the swing lever member 114 from it restrained state. Thus, when at step S13, the motor 113 is rotated in the sheet reverse feed direction, that is, the idle gear 114B is rotated counterclockwise, the swing lever member 114 is also pivoted thereby and, in the timing gear 24, as shown in FIG. 18B, the pinion 131B of the swing lever member 114 meshed with the internal toothed portion 26A of the inscribing gear portion 26 and at the same time, the pinion 132B which has so far been in meshing engagement with the large gear 9A on the sheet feed roller shaft 6A becomes disengaged from the large gear 9A.

Figure 18B:
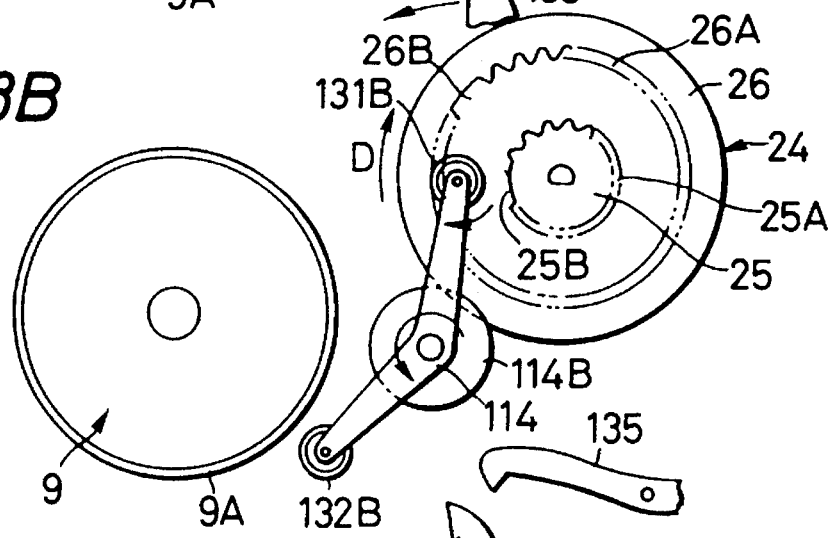

Consequently, the timing gear 24 is rotated in the direction of arrow D as shown in FIG. 18B, and the feed roller 20 starts to rotate through the intermediary of the feed roller shaft 23. In this state, power supply to the solenoid 137 is stopped. FIG. 7A shows the state before the feed roller 20 starts to rotate, and as the rotation of the feed roller 20 in the direction of arrow D progresses from this state, the large-diametered peripheral surface portion 20B thereof comes into contact with the upper surface of the sheets 50 and therefore, only the uppermost one of the sheets 50 is separated by the friction force with the aid of the separating pawl 45A and fed out toward the roller 6.

Figure 18C:
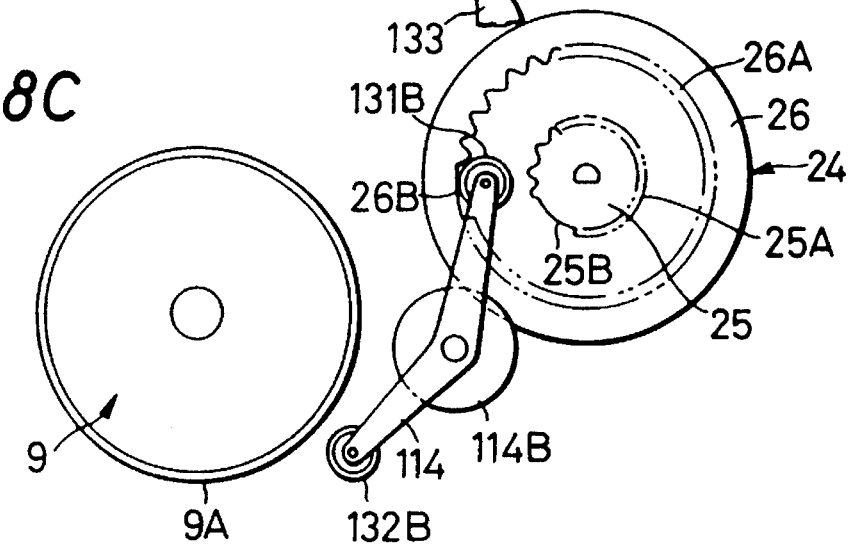

FIG. 7B shows the state in which the leading end edge of the sheet 50 has been directed to between the sheet feed roller 6 and the pinch roller 51 in the manner described above. In this state, the sheet 50 is kept in the form of a loop, while in the timing gear 24, the pinion 131B is directed to the untoothed portion 26B of the circumscribing gear portion 26 as shown in FIG. 18C, and as the rotation of the timing gear 24 is stopped, the feed roller 6 is also stopped.

So, when at step S14, the sheet feed motor 113 is rotated in the sheet feeding direction or forward direction, the swing lever member 114 is rotated in the same direction by the rotation of the idle gear 114B in the direction of arrow B (FIG. 15), whereby the pinions 131B and 132B thereof can be brought into meshing engagement with the circumscribing gear portion outer teeth 25A of the timing gear 24 and the large gear 9A on the sheet feed roller 6 side, and the sheet feed roller 6 is rotated, whereby the sheet 50 can be interposed between the sheet feed roller and the pinch roller 51 as shown in FIG. 7C. At this time, the feed roller 20 is also rotated, but at this timing, the small-diametered peripheral surface portion 20A of the feed roller 20 is at a position opposed to the sheet 50 and accordingly, the sheet feeding by the feed roller 20 does not take place, and when pinion 131B is rotated to the untoothed portion 25B of the inscribing gear portion 26, the feed roller 20 is stopped and kept in the state as shown in FIG. 18A.

At step S14, recording of one line is also effected.

Next, at step S15, whether there is a sheet reverse feed command is judged, and if there is such command, the motor 113 is rotated in reverse direction at step S18. At this time, the engaging member 133 is already restrained by the trigger lever 135 and therefore, the swing lever member 114 cannot be rotated counterclockwise as viewed in FIG. 18A. Accordingly, the paper feed roller 20 is not rotated.

When recording is terminated at step S16, the sheet is completely discharged into the stocker 52 at step S17.

Now, in the present embodiment, the flange portion 121B present in the first embodiment is used as a cam for depressing the separating pawl member.

Figure 19:
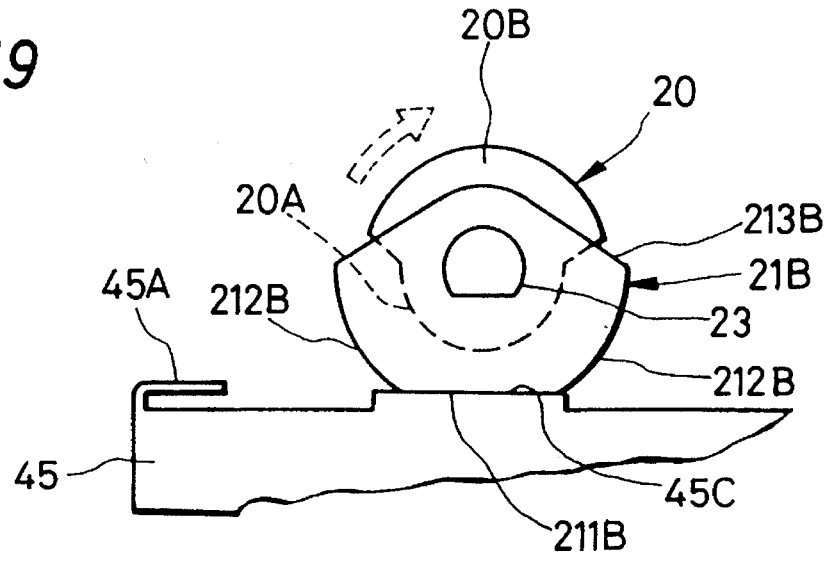
Figure 20A:
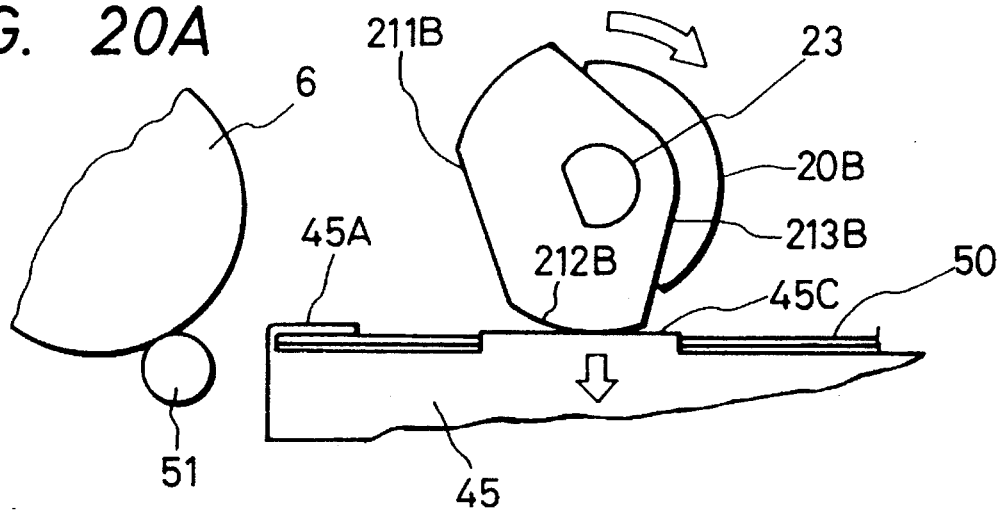
Figure 20B:
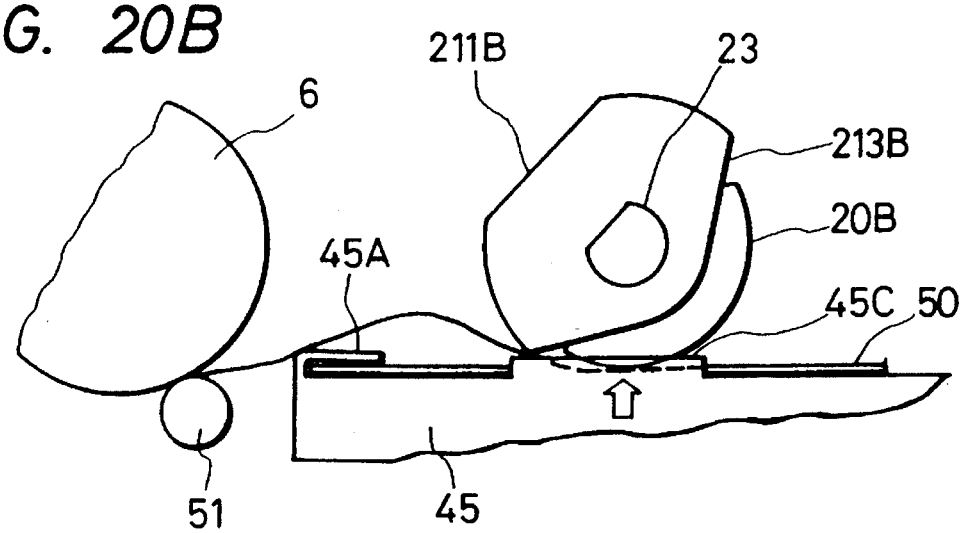

Reference is now had to FIGS. 19, 20A and 20B to describe the operation performed by the flange portion 21B of the aforementioned feed roller base member 21 from after the feed roller 20 begins to rotate from its standby state as shown in FIG. 7A until it feeds a sheet.

The feed roller 20 and the roller base member 21 are fixed to the roller shaft 23 so that their circumferential relative position is such as shown in FIG. 19, and the flange portion 21B of the roller base member 21 has a stopper cam portion 211B, a depressing cam portion 212B and an escape cam portion 213B formed on the peripheral surface thereof. Thus, in the standby state in which the feeding operation is not effected, that is, in the state in which the feed roller 20 has been returned to the start position as shown in FIG. 7A after the feeding operation, the stopper cam portion 211B of the flange portion 21B is engaged with the stopper portion 45C of the separating pawl member 45 to prevent the feed roller 20 from being inadvertently rotated by vibration or other reason.

So, when the feeding operation is entered, the feed roller shaft 23 is rotated to thereby rotate the feed roller 20 and the roller base member 21, not shown in these figures, in the direction of the arrow, whereby the separating pawl holding member 45 is depressed downwardly by the depressing cam portion 212B as shown in FIG. 20A. By this depressing operation, the sheet 50 is also depressed downwardly through the separating pawl 45A and a sufficient gap is kept between the upper surface of the sheets 50 and the feed roller 20.

Then, with the rotation of the feed roller shaft 23, the stopper member 45C of the separating pawl holding member 45 is liberated from the depressing cam portion 212B as shown in FIG. 20B and at the same time, the large-diametered peripheral surface portion 20B, i.e., the feeding peripheral surface portion, of the feed roller 20 comes into contact with the upper surface of the sheets 50. In this state, the separating pawl holding member 45 is liberated from the flange portion 21B, whereby the separating pawl 45A is only in light contact with the end portion of the uppermost sheet 50 simply by gravity and accordingly, the sheet 50 can be fed out smoothly without resistance.

Thereafter, when the feeding is completed by the large-diametered feeding peripheral surface portion 20B, the feed roller 20 and the flange portion 21B are returned to their states shown in FIG. 19 by the continued rotation of the roller shaft 23.

(Another Embodiment)

Figure 21:
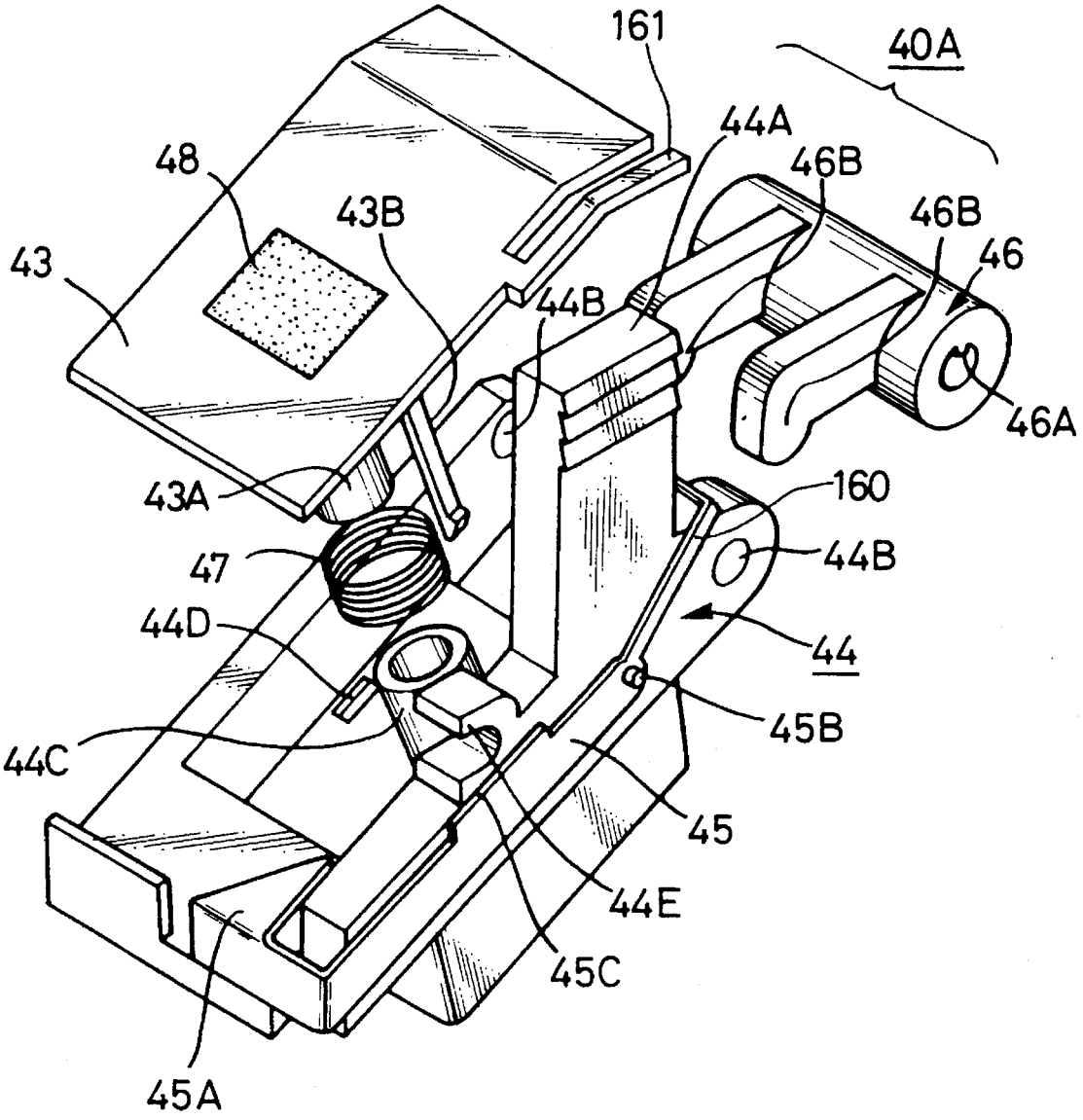
FIGS. 21 and 22A–22C show a fifth embodiment of the present invention, FIG. 21 being a perspective view of a slider unit, and FIGS. 22A–22C illustrating its operation.

FIGS. 21 and 22 show a fifth embodiment of the present invention. In this embodiment, when a bundle of sheet is to be loaded onto each slider unit 40A, 40B, the separating pawl 45A may be moved up by the depression of the pressure plate 43. In the present embodiment, the other portions are identical to those in the previously described embodiments and are given similar reference characters and need not be described.

Figure 22A:
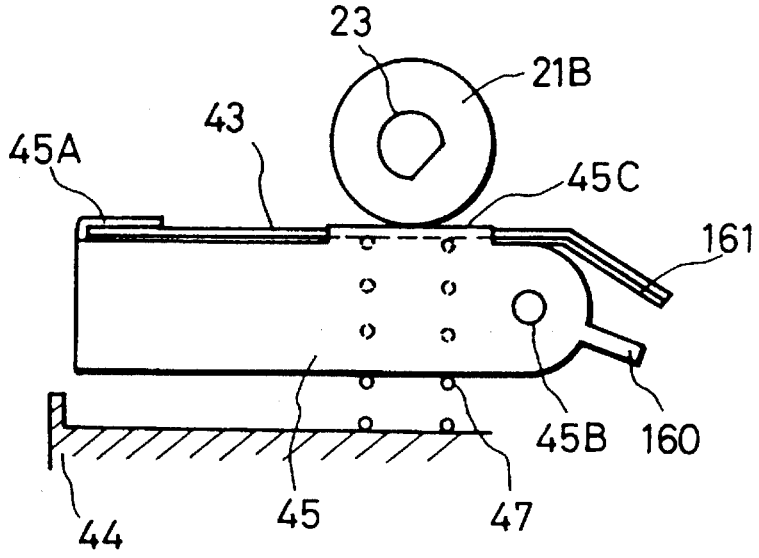

The then related operations of the pressure plate 43 and the separating pawl member 45 will hereinafter be described with reference to FIGS. 22A–22C. Assuming that no sheet is placed on the pressure plate 43, the pressure plate 43 is biased toward the flange portion 21B of the feed roller base member 21 by the spring 47 as described above, and is kept in its state as shown in FIG. 22A.

Figure 22B:
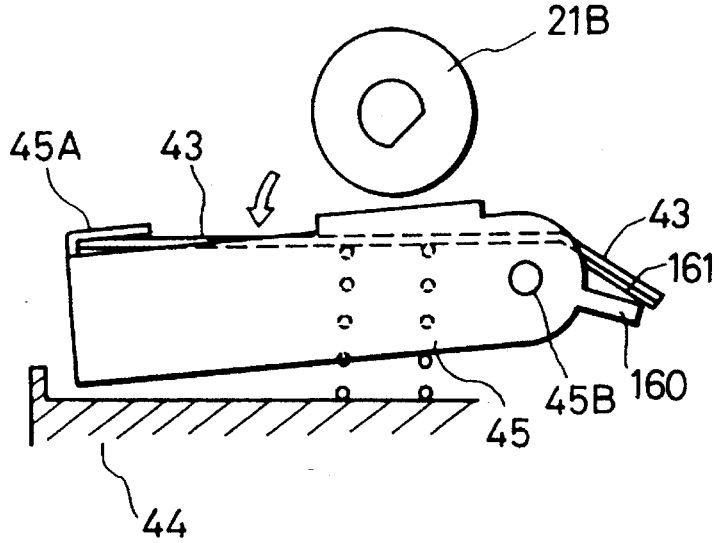
Figure 22C:
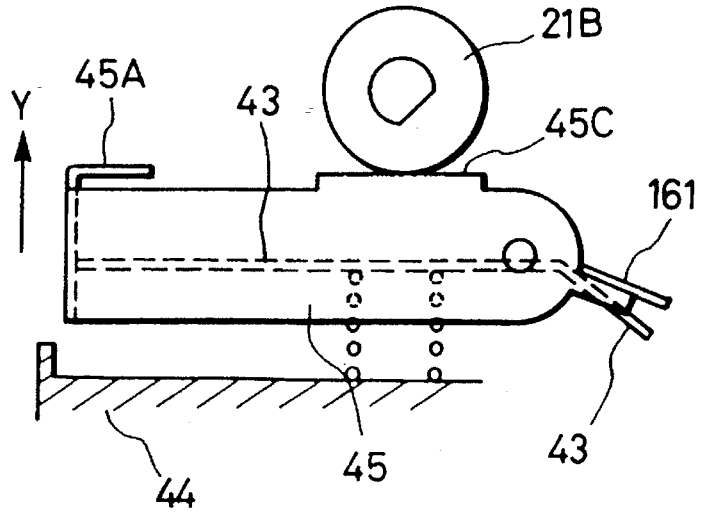

Here, when the pressure plate 43 begins to be depressed by the manual operation of the paper feed lever 42 (see FIG. 3), the tip end of the separating pawl member 45, pivotally supported by means of the shaft pin 45B so as to be pivotable in response to the movement of the sheet during paper feeding, is lowered by its gravity, and the separating pawl 45A comes into contact with the upper surface of the pressure plate 43, as shown in FIG. 22B.

Thus, if there is no means for cocking the separating pawl member 45 and the depression of the pressure plate 43 is further continued, the tip end of the separating pawl member 45 bears against the slider base member 44 and in this state, the gap between the separating pawl 45A and the upper surface of the pressure plate 43 is very narrow and, as previously described, it is difficult to insert the sheet into such gap and in some cases, a part of the sheet will protrude upwardly from the separating pawl 45A to cause jam.

In the present embodiment, however, if the above-mentioned depression of the pressure plate 43 is continued, the resilient arm portion 161 of the pressure plate 43 depresses the arm portion 160 of the separating pawl member 45 from above it by the spring force thereof, and by the lever action thereof, the tip end of the separating pawl member 45 is raised in a direction Y. In this case, the stopper 45C of the member 45 bears against the flange portion, while the pressure plate 43 has its lock pawl 43B restrained in a rectangular hole 44D, whereafter it is somewhat elevated by an amount corresponding to the engagement play thereof, but a sufficient spacing can be kept between the separating pawl 45A and the paper feed roller, not shown, and the pressure plate 43 and thus, it becomes possible to insert and set a bundle of sheets therein without any hindrance.

In the foregoing description, the pressure plate 43 itself or the arm portion 161 thereof has been described as a resilient member, but alternatively, the arm portion 160 of the separating pawl member 45 may be formed of a resilient material and the separating pawl 45A may be raised by the rigid arm portion 161 of the pressure plate while any stress caused by the irregularity of the dimensional tolerance between the parts is absorbed by the deformation of the arm portion 160.

I claim:

1. An image forming apparatus, comprising:

sheet stacking means for supporting a stack of sheets;

separation means having a separation pawl for separating a sheet from the stack of sheets by regulating a front edge and upper surface of the stack of sheets and a holding member disposed at a side area of the sheet stack in said sheet stacking means for holding the separation pawl rockably in a sheet stack direction, said separation means being rockably supported;

a feed rotary member having an arc surface of predetermined radius for applying a feeding force to the uppermost sheet of the sheet stack and a cut portion which is formed such that a distance from a center to a contour of the cut portion is smaller than the radius of the arc surface;

bias means for biasing said sheet stacking means toward said feed rotary member; and cam means for regulating the holding member, said cam means having a cam portion a distance of which from a center to a contour being larger than that of the cut portion of said feed rotary member, an escape cam portion distance of which from a center to a contour being smaller than that of the arc surface when the cut portion opposes the sheet, the cam portion regulating the holding member so that said separation pawl regulates the upper surface of the sheet stack to form a gap between the cut portion and the sheet, wherein a position of the cam portion to release regulation of said holding member is set so that a step portion between the cut portion and the arc surface does not abut the sheet when the arc surface abuts the sheet; and image forming means for forming an image onto a sheet fed by said feed rotary member.

2. An image forming apparatus, comprising:

sheet stacking means for supporting a stack of sheets;

separation means having a separation pawl for separating a sheet from the stack of sheets supported by said sheet stacking means by regulating a front edge and an upper surface of the sheet stack and a holding member disposed at a side area of the sheet stack in said sheet stacking means for holding said separation pawl rockably in a sheet stack direction, said separation means being rockably supported at a point remote from the separation pawl;

a feed rotary member having an arc surface of predetermined radius for applying a feeding force to the uppermost sheet of the sheet stack, and a cut portion which is formed such that a distance from a center to a contour of the cut portion is smaller than the radius of the arc surface, the arc surface and the cut portion being at different positions from each other in a circumferential direction of said feed rotary member;

bias means for biasing said sheet stacking means toward said feed rotary member;

cam means disposed to rotate together with said feed rotary member for regulating said holding member, wherein said holding member and said cam means are so related that when the cut portion of said feed rotary member opposes the sheet stack said cam means regulates the holding member so that said separation pawl regulates the upper surface of the sheet stack to form a gap between the cut portion and the sheet stack against the bias force of said biasing means, and when regulation of the holding member by said cam means is released the arc surface feeds the uppermost sheet; and image forming means for forming an image onto the fed sheet.

3. An image forming apparatus according to claim 2, wherein said image forming means has an ink jet recording head.

4. A sheet feeding device comprising:

sheet stacking means for supporting a stack of sheets;

separation means having a separation pawl for separating a sheet from the stack of sheets supported by said sheet stacking means by regulating a front edge and an upper surface of the sheet stack and a holding member disposed at a side area of the sheet stack in said sheet stacking means for holding said separation pawl rockably in a sheet stack direction, said separation means being rockably supported at a point remote from the separation pawl;

a feed rotary member having an arc surface of predetermined radius for applying a feeding force to the uppermost sheet of the sheet stack, and a cut portion which is formed such that a distance from a center to a contour of the cut portion is smaller than the radius of the arc surface, the arc surface and the cut portion being at different positions from each other in a circumferential direction of said feed rotary member;

bias means for biasing said sheet stacking means toward said feed rotary member; and cam means disposed to rotate together with said feed rotary member for regulating said holding member, wherein said holding member and said cam means are so related that when the cut portion of said feed rotary member opposes the sheet stack said cam means regulates the holding member so that said separation pawl regulates the upper surface of the sheet stack to form a gap between the cut portion and the sheet stack against the bias force of said biasing means, and when regulation of the holding member by said cam means is released the arc surface feeds the uppermost sheet.

5. A sheet feeding device according to claim 4, wherein said separation pawl has a first regulation portion for regulating movement of the sheet in forward direction, and a second regulation portion for regulating movement of the sheet in stacking direction, both of which are disposed corresponding to a corner of a tip end of the sheet.

6. A sheet feeding device according to claim 4, wherein said separation pawl and said holding means are integrally formed, and by abutting of said cam means onto said holding member when the cut portion of said feed rotary member is opposed to the sheet, the second regulation portion regulates movement of the sheet stack in the sheet stacking direction, thereby maintaining said holding member and said feed rotary member separated from each other.

7. A sheet feeding device according to claim 4, wherein said cam means is supported coaxially with said feed rotary member, said cam means having a cam portion to be opposed to the holding member when the cut portion of said feed rotary member opposes to the sheet, and an escape cam portion to be opposed to the holding member when the arc portion of said feed rotary member opposes the sheet, a distance from a center to a contour of the cam portion being larger than that of the cut portion, a distance from a center to a contour of said escape cam portion being smaller than a radius of the arc surface.

8. A sheet feeding device according to claim 7, wherein said cam means has a flat surface regulating movement thereof in a waiting state where the cut portion of said feed rotary member opposes the sheet stack.

9. A sheet feeding device according to claim 7, wherein the arc surface of said rotary member and the cam portion of said cam means are disposed symmetrically.

10. A sheet feeding device, comprising:

sheet stacking means for supporting a stack of sheets;

separation means having a separation pawl for separating a sheet from the stack of sheets by regulating a front edge and upper surface of the stack of sheets and a holding member disposed at a side area of the sheet stack in sad sheet stacking means for holding the separation pawl rockably in a sheet stack direction, said separation means being rockably supported;

a feed rotary member having an arc surface of predetermined radius for applying a feeding force to the uppermost sheet of the sheet stack and a cut portion which is formed such that a distance from a center to a contour of the cut portion is smaller than the radius of the arc surface;

bias means for biasing said sheet stacking means toward said feed rotary member; and cam means for regulating the holding member, said cam means having a cam portion a distance of which from a center to a contour being larger than that of the cut portion of said feed rotary member, an escape cam portion a distance of which from a center to a contour being smaller than that of the arc surface when the cut portion opposes the sheet, the cam portion regulating the holding member so that said separation pawl regulates the upper surface of the sheet stack to form a gap between the cut portion and the sheet, wherein a position of the cam portion to release regulation of said holding member is set so that a step portion between the cut portion and the arc surface does not abut the sheet when the arc surface abuts the sheet.

11. A sheet feeding device according to claim 10, wherein the cam portion has an arc profile a circumferential length of which is so selected that the arch portion releases regulation of said holding member at a position opposing the sheet so that the step portion does not abut against the sheet.

12. A sheet feeding device according to claim 10, wherein said cam means is disposed coaxially with said feed rotary member to rotate together.

13. A sheet feeding device according to claim 10, wherein the separation pawl and the holding member are formed integrally with each other.

* * * * *

UNITED STATES PATENT AND TRADEMARK OFFICE

CERTIFICATE OF CORRECTION

PATENT NO. : 5,531,531
DATED : July 2, 1996
INVENTOR(S) : HIROFUMI HIRANO

It is certified that error appears in the above-indentified patent and that said Letters Patent is hereby corrected as shown below:

Column 1,
line 32, need" should read --need to--.
Column 2,
line 17, "and as far as possible" should read --and, as far as possible,--.
Column 4,
line 48, "force,,the" should read --force, the--.
Column 16,
line 1, "claim 4," should read --claim 5,--;
line 31, "sad" should read --said--; and
line 57, "arch" should read --cam--.

Signed and Sealed this

Third Day of December, 1996

*Attest:*

*Attesting Officer*

BRUCE LEHMAN

*Commissioner of Patents and Trademarks*